US008542864B2

(12) United States Patent
Tanabe

(10) Patent No.: US 8,542,864 B2
(45) Date of Patent: Sep. 24, 2013

(54) SPEAKER DEVICE

(75) Inventor: Kei Tanabe, Iwaki (JP)

(73) Assignee: Alpine Electronics, Inc., Tokyo (JP)

( * ) Notice: Subject to any disclaimer, the term of this patent is extended or adjusted under 35 U.S.C. 154(b) by 252 days.

(21) Appl. No.: 12/958,026

(22) Filed: Dec. 1, 2010

(65) Prior Publication Data

US 2011/0135139 A1 Jun. 9, 2011

(30) Foreign Application Priority Data

Dec. 7, 2009 (JP) ..... 2009-277628

(51) Int. Cl.
*H04R 1/00* (2006.01)

(52) U.S. Cl.
USPC ..... 381/407; 381/386; 381/424; 381/395; 381/398; 381/412

(58) Field of Classification Search
USPC ..... 381/431, 396, 399, 407, 386, 423, 381/424, 421, 422, 395, 398, 412
See application file for complete search history.

(56) References Cited

U.S. PATENT DOCUMENTS

| | | | | |
|---|---|---|---|---|
| 4,544,805 | A | 10/1985 | Sawafuji | |
| 6,421,449 | B1 * | 7/2002 | Hasegawa et al. | 381/401 |
| 7,376,240 | B2 * | 5/2008 | Hansen et al. | 381/421 |
| 8,259,987 | B2 * | 9/2012 | Omoda | 381/423 |
| 2005/0276435 | A1 * | 12/2005 | Watanabe | 381/399 |

FOREIGN PATENT DOCUMENTS

| | | |
|---|---|---|
| JP | 58-48194 | 9/1956 |

* cited by examiner

*Primary Examiner* — Davetta W Goins
*Assistant Examiner* — Amir Etesam
(74) *Attorney, Agent, or Firm* — Brinks Hofer Gilson & Lione

(57) ABSTRACT

A speaker device includes a voice coil unit and a diaphragm linked to the voice coil unit. A first supporting unit and a second supporting unit elastically support the end portions of the voice coil unit so that the voice coil portion of the voice coil unit can vibrate within the magnetic gap in the direction of the face thereof. Each of the first supporting unit and the second supporting unit has a configuration that is in a shape bent so as to extend up and bend down from an end that is fixed to a fixing position. Thus, a speaker device in which the voice coil unit can vibrate with a greater amplitude is provided.

10 Claims, 21 Drawing Sheets

SPEAKER DEVICE

RELATED APPLICATION

The present application claims priority to Japanese Patent Application Number 2009-277628, filed Dec. 7, 2009, the entirety of which is hereby incorporated by reference.

BACKGROUND OF THE INVENTION

1. Field of the Invention

The present invention relates to a speaker device that outputs sound by vibrating a diaphragm which is connected to a voice coil by mutual action between a magnetic field generated in a magnetic circuit and an audio signal current that flows through the voice coil.

2. Description of the Related Art

Heretofore, an angular and thin-shaped speaker device has been proposed (see Japanese Unexamined Utility Model Registration Application Publication No. 58-48194). This speaker device is configured so that a flat drive plate (voice coil unit) formed of a voice coil is disposed within a magnetic gap formed by two magnets, and one end portion of the drive plate is attached to the back face of the flat diaphragm. The other end portion of the drive plate is elastically supported by a supporting member so that the drive plate can vibrate within the magnetic gap in a direction parallel to the face thereof. With such a configuration, the drive plate vibrates in a direction parallel to the face thereof by mutual action between the audio signals supplied to the voice coil and the magnetic flux that cuts across the magnetic gap, and sound is output corresponding to the audio signals by the flat diaphragm, to which the vibrating drive plate is attached.

However, with the above-described current speaker device, one end portion of the drive plate (voice coil unit) is attached to the flat diaphragm and the opposite end portion of the drive plate is elastically supported by a supporting member, whereby obtaining amplitude by the drive plate (voice coil unit) in the direction parallel to the face thereof is difficult. Therefore, obtaining a loud audio output is difficult.

The present invention takes this situation into account, and provides a speaker device wherein the voice coil unit can vibrate with a greater amplitude.

SUMMARY

A speaker device according to one embodiment of the present invention has a configuration including a magnetic circuit forming a magnetic gap; a voice coil unit disposed in the magnetic gap; and a diaphragm linked to the voice coil unit. The voice coil unit further includes a voice coil line patterns formed on the surface of a flat flexible material, and a first supporting unit and a second supporting unit that elastically support the voice coil unit, which are formed following both end portions of the voice coil portion of the flat flexible material. An end portion of the first supporting unit and the second supporting unit, which is on the side opposite from the voice coil portion, is fixed to a fixing position to enable vibrations of the voice coil portion within the magnetic gap in the direction of the face thereof and each of the first supporting unit and the second supporting unit elastically support the voice coil portion in a shape that extends up and bends down from the end portion that is fixed to the fixing position.

With such a configuration, each of the first supporting unit and the second supporting unit following from both end portions of the voice coil portion disposed within the magnetic gap formed in the magnetic circuit are elastically supporting the voice coil portion in a form that extends up from the end portion fixed to the fixing position and bends down, whereby when the voice coil portion vibrates within the magnetic gap in the face direction thereof, the vibrations of the voice coil portion are maintained while deforming the bent form of each of the first supporting unit and the second supporting unit in accordance with the vibrations of the voice coil portion.

The speaker device may have a configuration wherein connecting points are formed at the edge portions fixed to the fixing position of at least one of the first supporting unit and the second supporting unit, and a line pattern following the connecting points through the voice coil line pattern is formed on the at least one of the first supporting unit and the second supporting unit.

With such a configuration, a connecting point connected to the voice coil line pattern is formed on at least one end portion of the first supporting unit and the second supporting unit fixed to the fixing position, whereby a lead line supplying an audio signal to the voice coil line pattern via the connecting points can be distributed without influence from the vibrations of the voice coil portion.

Also, the speaker device may have a configuration further including positioning members that determine the positions of parts making up the magnetic circuit, wherein the fixing positions to which the end portions of each of the first supporting unit and the second supporting unit are fixed are set in the positioning members.

With such a configuration, the end portions of each of the first supporting unit and the second supporting unit that elastically support the voice coil portion are fixed by the positioning members that determine positions of the parts making up the magnetic circuit, whereby assembly of the magnetic circuit and the voice coil unit can be easily performed.

The speaker device may have a configuration wherein the fixing positions to which at least one of the edge portions of the first supporting member and the second supporting member on which the connecting points are formed is fixed, is set so as to be a concave portion, and by fitting the terminal member having corresponding connecting points into the concave portion, the audio signal from the outside is supplied to the voice coil line pattern via the terminal member.

With such a configuration, by fitting the terminal member into the concave portion wherein the fixing position is set, to which at least one end portion of the first supporting unit and the second supporting unit is fixed, the audio signal is supplied to the voice coil line pattern via the terminal member, whereby the audio signal can be supplied to the voice coil line pattern without soldering.

A speaker device according to an embodiment of the present invention has a configuration including a magnetic circuit forming a magnetic gap; a voice coil unit disposed in the magnetic gap; and a diaphragm linked to the voice coil unit, the magnetic circuit further forming two facing magnetic gaps. The voice coil unit includes a first voice coil portion including a first voice coil line pattern formed on the surface of a flat flexible material; a second voice coil portion including a second voice coil line pattern formed on the surface of a flat flexible material; a first-first supporting unit and a second-first supporting unit which are formed following both edge portions of the first voice coil portion of the flat flexible material, and which elastically support the first voice coil portion; a first-second supporting unit and a second-second supporting unit which are formed following both edge portions of the second voice coil portion of the flat flexible material, and which elastically support the second voice coil portion; wherein the edge portion on the side opposite from the first voice coil portion of each of the first-first supporting unit and the second-first supporting unit is fixed to fixing positions so as to enable vibration of the first voice coil portion in one of the magnetic gaps in the direction of the face thereof; wherein the edge portion on the side opposite from the second voice coil portion of each of the first-second supporting unit and the second-second supporting unit is fixed to fixing positions so as to enable vibration of the second voice coil portion in the other of the magnetic gaps in the direction of the face thereof; wherein each of the first-first supporting unit and the second-first supporting unit elastically supports the first voice coil portion in a bent shape that extends up from the end portion fixed to the fixing position and bends down; and wherein each of the first-second supporting unit and the second-second supporting unit elastically supports the second voice coil portion in a bent shape that extends up from the end portion fixed to the fixing position and bends down.

With such a configuration, each of the first-first supporting unit and the second-first supporting unit following from the end portions of the first voice coil portion disposed in one of the magnetic gaps formed in the magnetic circuit elastically supports the first voice coil portion in a form that extends up from the end portions fixed to the fixing position and bends down, and each of the first-second supporting unit and the second-second supporting unit following from the end portions of the second voice coil portion disposed in the other of the magnetic gaps formed in the magnetic circuit elastically supports the second voice coil portion in a form that extends up from the end portions fixed to the fixing positions and bends down, whereby when the first voice coil portion and the second voice coil portion vibrate within the magnetic gaps in the direction of the faces thereof, the vibration of the first voice coil portion is maintained while deforming the bent form of each of the first-first supporting unit and the second-first supporting unit in accordance with the vibrations of the first voice coil portion, and also, the vibration of the second voice coil portion is maintained while deforming the bent form of each of the first-second supporting unit and second-second supporting unit in accordance with the vibrations of the second voice coil portion.

The speaker device may have a configuration wherein a connecting point is formed on the end portion fixed to at least one of the fixing positions of the first-first supporting unit and the second-first supporting unit of the voice coil unit, and a line pattern following the connecting point through the first voice coil line pattern is formed on at least one of the first-first supporting unit and the second-first supporting unit including the connecting point on the end portion.

With such a configuration, a connecting point connected to the first voice coil line pattern is formed on at least one end portion of the first-first supporting unit and the second-first supporting unit fixed to the fixing position, whereby the lead line supplying the audio signal to the first voice coil line pattern via the connecting point can be distributed without influence from the vibration of the first voice coil portion.

The speaker device may have a configuration wherein a connecting point is formed on the end portion fixed to at least one of the fixing positions of the first-second supporting unit and the second-second supporting unit, and a line pattern following the connecting point through the second voice coil line pattern is formed on at least one of the first-second supporting unit and the second-second supporting unit including the connecting point on the end portion.

With such a configuration, a connecting point connected to the second voice coil line pattern is formed on at least one end portion of the first-second supporting unit and the second-second supporting unit fixed to the fixing position, whereby the lead line supplying the audio signal to the second voice coil line pattern via the connecting point can be distributed without influence from the vibration of the second voice coil portion.

The speaker device may have a configuration further including positioning members that determine the position of the parts making up the magnetic circuit, wherein the fixing positions to which the end portions of each of the first-first supporting unit and the second-first supporting unit are fixed, and wherein the fixing positions to which the end portions of each of the first-second supporting unit and the second-second supporting unit are fixed, are set in the positioning members.

With such a configuration, each end portion of the first-first supporting unit and the second-first supporting unit that elastically supports the first voice coil portion is fixed by the positioning members that determine the position of the parts making up the magnetic circuit, and also, each end portion of the first-second supporting unit and the second-second supporting unit that elastically supports the second voice coil portion is fixed by the positioning members that determine the position of the parts making up the magnetic circuit, whereby assembly of the magnetic circuit and the voice coil unit can be performed easily.

The speaker device may have a configuration wherein the fixing positions to which at least one of the end portions of the first-first supporting unit and the second-first supporting unit is fixed, is set into a concave unit, and a terminal member having a corresponding connecting point is fit into the concave portion, whereby audio signals are supplied from the outside via the terminal member to the first voice coil line pattern.

With such a configuration, by fitting the terminal member into the concave portion wherein the fixing position is fixed, to which at least one end portion of the first-first supporting unit and the second-first supporting unit is fixed, the audio signal is supplied to the first voice coil line pattern via the terminal member without soldering.

The speaker device may have a configuration wherein the fixing positions to which at least one of the end portions of the first-second supporting unit and the second-second supporting unit whereupon the connecting point is formed is set into a concave unit, and a terminal member having a corresponding connecting point is fit into the concave portion, whereby audio signals are supplied from the outside via the terminal member to the second voice coil line pattern.

With such a configuration, by fitting the terminal member into the concave portion wherein the fixing position is fixed, to which at least one end portion of the first-second supporting unit and the second-second supporting unit is fixed, the audio signal is supplied to the second voice coil line pattern via the terminal member without soldering.

A speaker device according to an embodiment of the present invention may have a configuration wherein the first-first supporting unit that follows from one end portion of the first voice coil portion and the first-second supporting unit that follows from one end portion of the second voice coil portion are formed so as to be continuous, and the border portion between the first-first supporting unit and the first-second supporting unit is fixed to the first fixing position; and the second-first supporting unit that follows from the other end portion of the first voice coil portion and the second-second supporting unit that follows from the other end portion of the second voice coil portion are formed so as to be continuous, and the border portion between the second-first supporting unit and the second-second supporting unit is fixed to the second fixing position.

With such a configuration, the first-first supporting unit and the second-first supporting unit following the first voice coil portion and the first-second supporting unit and the second-second supporting unit following the second voice coil portion are formed so as to be continuous, whereby the first voice coil portion, the second voice coil portion, the first-first supporting unit, the second-first supporting unit, the first-second supporting unit, and the second-second supporting unit can be made from the same piece of flat flexible material, and the construction of the voice coil unit can be made simpler.

Also, each of the first-first supporting unit and the first-second supporting unit following one end portion of the first voice coil portion and the second voice coil portion elastically supports one end portion of the first voice coil portion and the second voice coil portion in a form that extends up from the border portions wherein the supporting units are fixed to a first fixing position and bends down, and each of the second-first supporting unit and the second-second supporting unit following the other end portion of the first voice coil portion and the second voice coil portion elastically supports the other end portion of the first voice coil portion and second voice coil portion in a form that extends up from the border portions wherein the supporting units are fixed to a second fixing position and bends down, whereby when the voice coil portion vibrates within the magnetic gap in the face direction thereof, the vibration of the voice coil portion is maintained while deforming the bent form of each of the first supporting unit and the second supporting unit in accordance with the vibration of the voice coil portion, and the vibration of the voice coil portion is maintained while deforming the bent form of each of the first supporting unit and the second supporting unit in accordance with the vibration of the voice coil portion.

The speaker device may have a configuration wherein a connecting point is formed on at least one of the border portion between the first-first supporting unit and the first-second supporting unit and the border portion between the second-first supporting unit and the second-second supporting unit, wherein a line pattern that follows the connecting point through the first voice coil line pattern and the second voice coil line pattern is formed on at least one of the first-first supporting unit and the first-second supporting unit and the second-first supporting unit and the second-second supporting unit.

With such a configuration, on at least one of the border portion between the first-first supporting unit and the first-second supporting unit fixed to the first and second fixing positions and the border portion between the second-first supporting unit and the second-second supporting unit, a line pattern following the connecting point through the first voice coil line pattern and the second voice coil line pattern is formed on at least one of the first-first supporting unit and the first-second supporting unit and the second-first supporting unit and the second-second supporting unit, whereby a lead line supplying an audio signal to the first voice coil line pattern and the second voice coil line pattern via the connecting point can be distributed without influence from the vibration of the first voice coil portion and the second voice coil portion.

The speaker device may have a configuration further including positioning members that determine the position of the parts making up the magnetic circuit, wherein the fixing positions to which the border portions of each of the first-first supporting unit and the first-second supporting unit are fixed, and wherein the fixing positions to which the border portions of each of the second-first supporting unit and the second-second supporting unit are fixed, are set in the positioning members.

With such a configuration, the border portion between the first-first supporting unit that elastically supports the first voice coil portion and the first-second supporting unit that elastically supports the second voice coil portion, and the border portion between the second-first supporting unit that elastically supports the first voice coil portion and the second-second supporting unit that elastically supports the second voice coil portion, are fixed by the positioning members that determine the position of the parts making up the magnetic circuit, whereby assembly of the magnetic circuit and the voice coil unit can be performed easily.

The speaker device may have a configuration wherein at least one of the first fixing position and the second fixing position, where at least one of the border portion between the first-first supporting unit and the first-second supporting unit on which the connecting point is formed, and the border portion between the second-first supporting unit and the second-second supporting unit is fixed, is set into a concave portion; and wherein a terminal member having a corresponding connecting point is fit into the concave portion, whereby audio signals are supplied from the outside via the terminal member to the first voice coil line pattern and the second line pattern.

With such a configuration, by fitting the terminal member into the concave portion wherein at least one of the first fixing position and second fixing position has been set, to which at least one of the border portion between the first-first supporting unit and the second-first supporting unit and the border portion between the second-first supporting unit and the second-second supporting unit is fixed, the audio signal is supplied to the first voice coil line pattern and the second voice coil line pattern via the terminal member, whereby the audio signal can be supplied to the first voice coil line pattern and the second voice coil line pattern without soldering.

According to these embodiments of the speaker device, when a voice coil portion vibrates within the magnetic gap in the direction of the face thereof, the vibrations of the voice coil portion are maintained while deforming the bent form of the first supporting unit and the second supporting unit in accordance with the vibrations of the voice coil portion, whereby in the amount that the bent forms of the first supporting unit and the second supporting unit that extend up and bend down are deformed, the amplitude of the vibrations of the first and second voice coil portions that are elastically supported can be increased. Accordingly, a speaker device can be realized wherein the voice coil unit can vibrate with a greater amplitude.

DESCRIPTION OF THE PREFERRED EMBODIMENTS

Embodiments of the present invention will be described below with reference to the appended diagrams. An external view of a speaker device according to an embodiment of the present invention is shown in FIG. 1.

Figure 1:
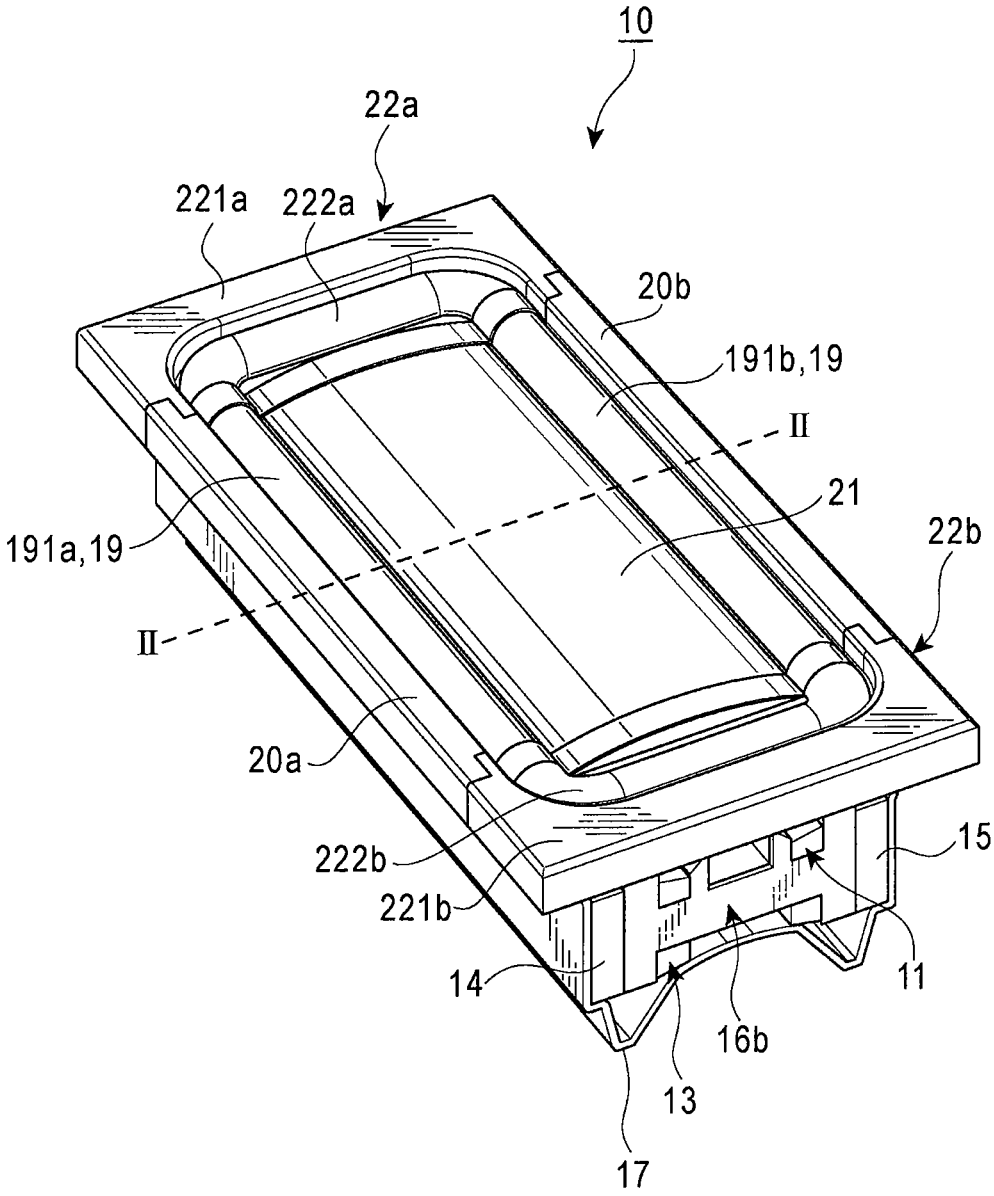
FIG. 1 is a perspective diagram illustrating an external view of a speaker device unit according to an embodiment of the present invention.
Figure 2:
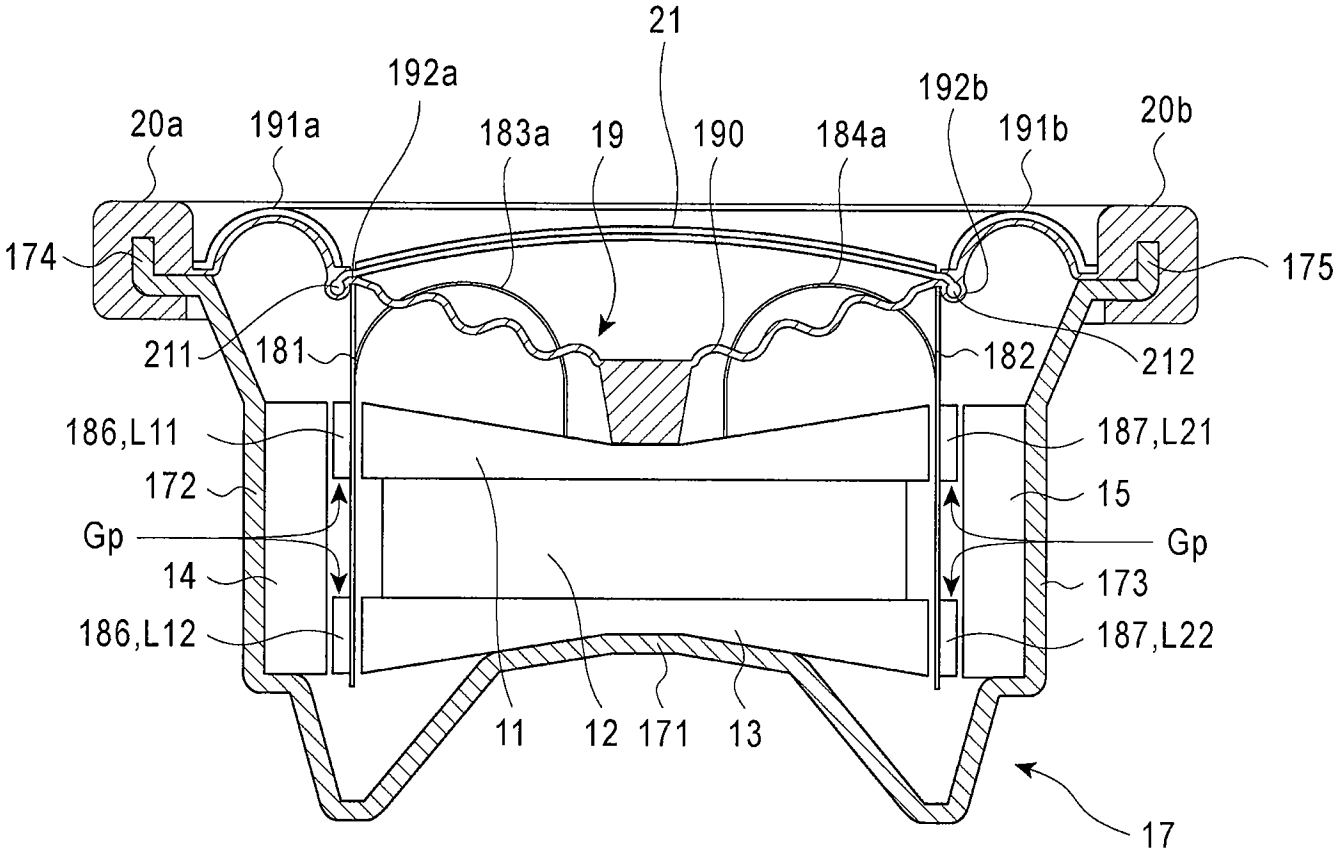
FIG. 2 is a cross-sectional diagram showing a cross-sectional configuration of the speaker device shown in FIG. 1 cut away along a line II-II.

A speaker device 10 shown in FIG. 1 is an angular shaped speaker device, is configured with the parts shown in FIGS. 3 through 12, and has the cross-sectional configuration shown in FIG. 2. Specifically, the speaker device 10 is formed by assembling the various parts of a rectangular plate-shaped metallic first inner yoke 11 shown in FIG. 3, a rectangular plate-shaped magnetic plate 12 shown in FIG. 4, a rectangular plate-shaped metallic second inner yoke 13 shown in FIG. 5, a first positioning member 16*a* made of a non-magnetic body (for example, a resin) shown in FIG. 6A, a second positioning member 16*b* made of a non-magnetic body (for example, a resin) shown in FIG. 6B, a first outer yoke 14 and a second outer yoke 15 shown in FIG. 7, a frame member 17 shown in FIG. 8, a voice coil unit 18 shown in FIG. 9, a damper member 19 shown in FIG. 10, a diaphragm 21 shown in FIG. 11, and a first horizontal edge unit 22*a* and a second horizontal edge unit 22*b* shown in FIG. 12.

Figure 3:
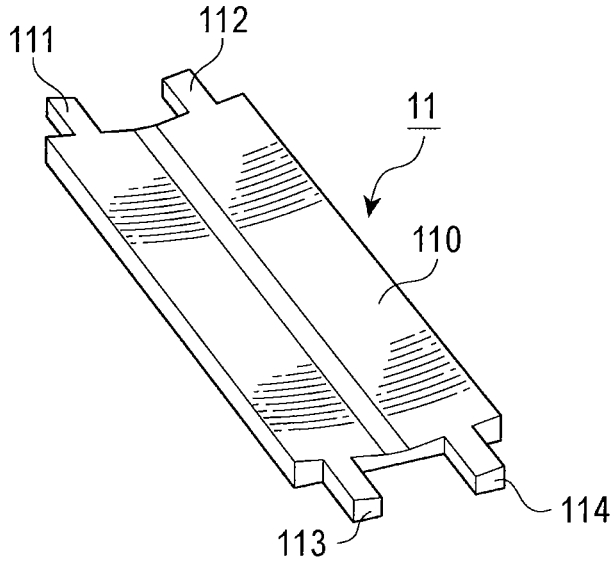
FIG. 3 is a perspective diagram showing a configuration of a first inner yoke.
Figure 4:
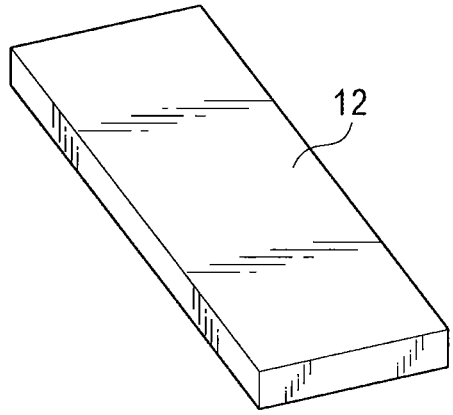
FIG. 4 is a perspective diagram illustrating a magnetic plate.
Figure 5:
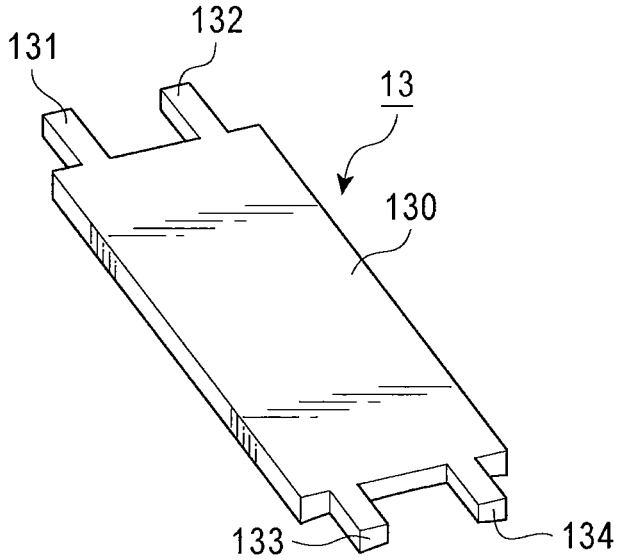
FIG. 5 is a perspective diagram illustrating a configuration of a second inner yoke.

The first inner yoke 11 (second inner yoke 13) shown in FIG. 3 (FIG. 5) has a configuration wherein positioning protrusions 111 and 112 (131 and 132) are formed as a pair on one end portion of the lengthwise direction of the rectangular plate-shaped yoke main unit 110 (130), while positioning protrusions 113 and 114 (133 and 134) are formed as a pair on the other end portion. Spacing of each pair of the positioning protrusions 111, 112 (131, 132) (113, 114) (133, 134), specifically, the distance between the external side faces, are set to predetermined lengths. The magnetic plate 12 shown in FIG. 4 is formed as a rectangular plate shape having a plate face with a slightly smaller area than the plate faces of the yoke main units 110, 130 of each of the first inner yoke 11 and the second inner yoke 13.

Figure 6A:
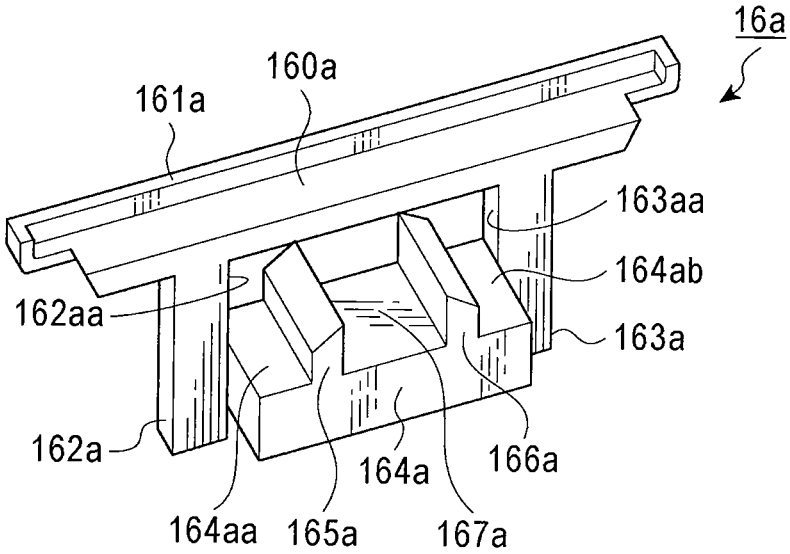
FIG. 6A is a perspective diagram illustrating a configuration of a first positioning member.
Figure 6B:
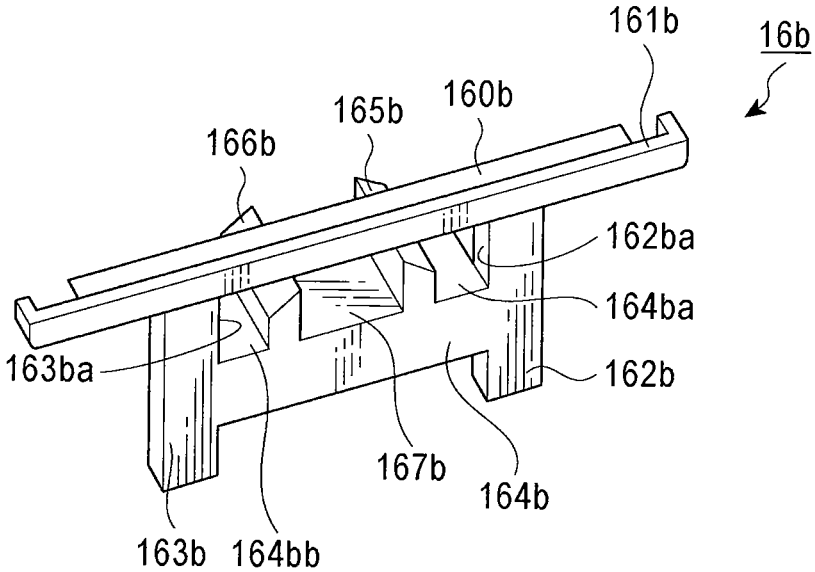
FIG. 6B is a perspective diagram illustrating a configuration of a second positioning member.

The first positioning member 16*a* shown in FIG. 6A and the second positioning member 16*b* shown in FIG. 6B are used to determine the positions of the first inner yoke 11, the second inner yoke 13, the first outer yoke 14, and the second outer yoke. The configuration of the first positioning member 16*a* will be described below, and the second positioning member 16*b* has the same configuration. In FIG. 6A (FIG. 6B), an angular-rod shaped first horizontal spacer unit 162*a* (162*b*) and a second horizontal spacer unit 163*a* (162*b*) are formed on a horizontal bar 160*a* (160*b*) so as to extend down therefrom. The spacing of the inner face 162*aa* (162*ba*) of the first horizontal spacer unit 162*a* (162*b*) and the inner face 163*aa* (163*ba*) of the second horizontal spacer unit 163*a* (163*b*) is set to the same distance as between the outer side face of the protrusion pairs 111, 112 (131, 132), (113, 114), (133, 134) of each of the above-described first inner yoke 11 and second inner yoke 13. Also, the width in the horizontal direction for each of the first horizontal spacer unit 162*a* (162*b*) and the second horizontal spacer unit 163*a* (163*b*) is set to a value corresponding to the spacing that the spacers should have. Note that the width is determined taking into account the horizontal width of each of the first inner yoke 11 and the second inner yoke 13 and the magnetic gap Gp that is to be formed.

A rectangular-shaped vertical spacer unit 164*a* (164*b*) is formed between the first horizontal spacer unit 162*a* (162*b*) and the second horizontal spacer unit 163*a* (163*b*), so as to connect the generally center portion thereof in the vertical direction of the respective inner faces 162*aa* (162*ba*), 163*aa* (163*ba*) thereof. The thickness in the vertical direction of the vertical spacer unit 164*a* (164*b*) is set to a value that corresponds to the spacing that the spacer should have. Note that this thickness is determined taking into account the spacing that the first inner yoke 11 and the second inner yoke 13 are to maintain, i.e. the thickness of the magnetic plate 12. Two protruding portions 165*a* (165*b*) and 166*a* (166*b*) are formed on the upper face of the vertical spacer unit 164*a* (164*b*), so as to extend in the direction orthogonal to the direction that the horizontal bar 160*a* (160*b*) extends, and in the form whereby the upper outer edges are chamfered. The two protruding portions 165*a* (165*b*) and 166*a* (166*b*) are positioned symmetrically on the right and the left of the center of the upper face of the vertical spacer unit 164*a* (164*b*), at a predetermined spacing. With the two protruding portions 165*a* (165*b*) and 166*a* (166*b*), the upper face of the vertical spacer unit 164*a* (164*b*) is divided into three portions. The portion between the two protruding portions 165*a* (165*b*) and 166*a* (166*b*) becomes a terminal set face 167*a* (167*b*) where the terminal unit of the voice coil unit 18 is set, as described later; the portion between one of the protruding portions 165*a* (165*b*) and the first horizontal spacer unit 162*a* (162*b*) becomes a first positioning face 164*aa* (164*ba*) for determining the position of the first inner yoke 11; and further, the portion between the other protruding portion 166*a* (166*b*) and the second horizontal spacer unit 163*a* (163*b*) becomes a second positioning face 164*ab* (164*bb*) for determining the position of the first inner yoke 11. The spacing between one of the protruding portions 165*a* (165*b*) and the first horizontal spacer unit 162*a* (162*b*) is set so as to correspond to the width of the positioning protrusion 111 (114) of the first inner yoke 11, and the spacing between the other protrusion 166*a* (166*b*) and the second horizontal spacer unit 163*a* (163*b*) is set so as to correspond to the width of the positioning protrusion 112 (113) of the first inner yoke 11. The lower face of the vertical spacer unit 164*a* (164*b*) which is on the opposite side from the upper face that is divided into three parts as described above becomes the positioning face to determine the position of the second inner yoke 13.

Note that an integrated outer frame unit 161*a* (161*b*) is formed on the horizontal bar 160*a* (160*b*). The outer frame unit 161*a* (161*b*) is linked to the first outer edge portion 174 and the second outer edge portion 175 of the frame member 17 to be described later, and forms an overall rectangular-shaped frame unit.

Figure 7:
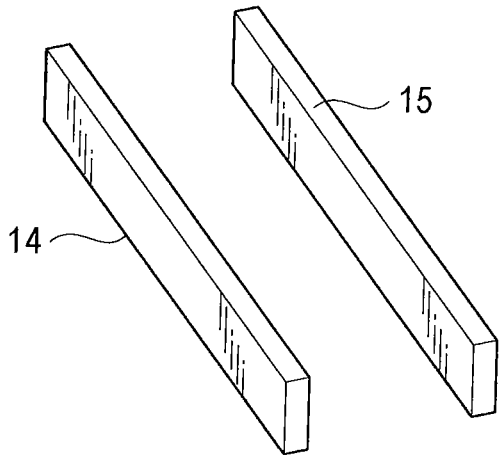
FIG. 7 is a perspective diagram illustrating a first outer yoke and a second outer yoke as a pair.
Figure 8:
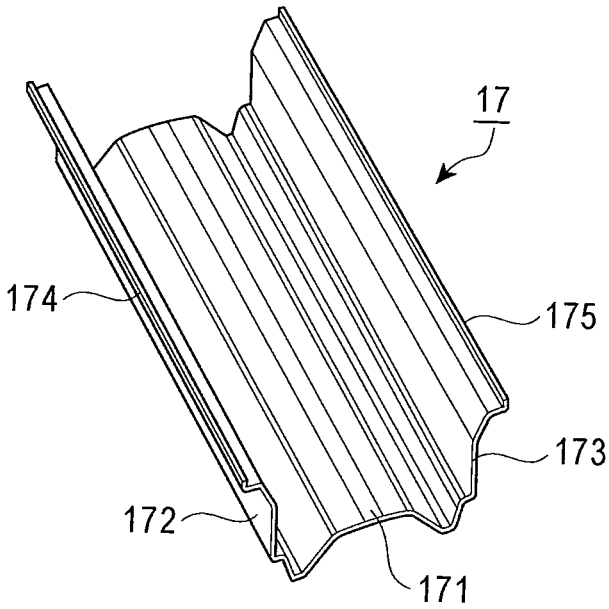
FIG. 8 is a perspective diagram illustrating a configuration of a frame member.

The first outer yoke 14 and the second outer yoke 15 shown in FIG. 7 are rectangular plate shapes, and along with the first inner yoke 11, the second inner yoke 13, and the magnetic plate 12, make up the magnetic circuit. The frame member 17 shown in FIG. 8 is formed by extrusion molding of metal or resin, and has a floor portion 171 having an arch shape on the inner side, a first pressing unit 172 that stands up following one of the end portions of the floor portion 171 and that is to press the first outer yoke 14 as will be described later, a second pressing unit 173 that stands up following the other end portion of the floor portion 171 and that is to press the second outer yoke 15 as will be described later, a first outer edge portion 174 formed following the first pressing unit 172, and a second outer edge portion 175 formed following the second pressing unit 173. The first outer edge portion 174 and the second outer edge portion 175 link with the outer frame portions 161*a* and 161*b* (see FIGS. 6A, 6B) of the first positioning member 16*a* and the second positioning member 16*b* as described above, to form the overall rectangular-shaped frame unit.

Figure 9:
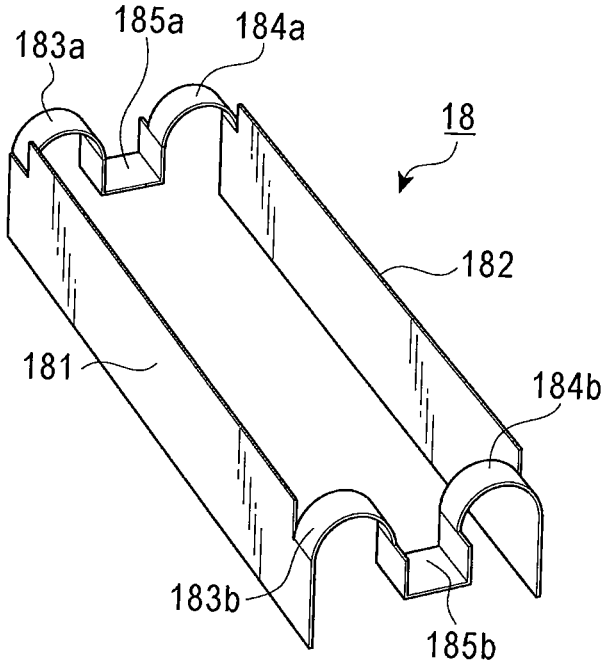
FIG. 9 is a perspective diagram illustrating a configuration of a voice coil unit relating to the first embodiment of the present invention.

The voice coil unit 18 shown in FIG. 9 is of a configuration having a first voice coil portion 181 that is formed in a first voice coil array pattern on the surface of a flat flexible board, a second voice coil portion 182 that is formed in a second voice coil array pattern on the surface of the flat flexible board, a first-first supporting unit 183*a* that is formed following one edge portion of the first voice coil portion 181 and that is in a bent state and elastically supports the one edge portion of the first voice coil portion 181, a second-first supporting unit 183*b* that is formed following the other edge portion of the first voice coil portion 181 and that is in a bent state and elastically supports the other edge portion of the first voice coil portion 181, a first-second supporting unit 184*a* that is formed following one edge portion of the second voice coil portion 182 and that is in a bent state and elastically supports the one edge portion of the second voice coil portion 182, a second-second supporting unit 184*b* that is formed following the other edge portion of the second voice coil portion 182 and that is in a bent state and elastically supports the other edge portion of the second voice coil portion 182. The first-first supporting unit 183*a* that elastically supports the one edge portion of the first voice coil portion 181 and the first-second supporting unit 184*a* that elastically supports the one edge portion of the second voice coil portion 182 are formed so as to be continuous, and the border portion thereof becomes a first terminal unit 185*a* having a U-shaped cross-section. Also, the second-first supporting unit 183*b* that elastically supports the other edge portion of the first voice coil portion 181 and the second-second supporting unit 184*b* that elastically supports the other edge portion of the second voice coil portion 182 are formed so as to be continuous, and the border portion thereof becomes a second terminal unit 185*b* having a U-shaped cross-section.

With the voice coil unit 18 shown in FIG. 9, the first terminal unit 185*a* and the second terminal unit 185*b* are maintained horizontally, and the first-first supporting unit 183*a* and the second-first supporting unit 183*b* follow both ends of the first voice coil portion 181 of which the surface is bent in a semi-circle or reverse-U-shape so as to extend up from one side of the first terminal unit 185*a* and the second terminal unit 185*b*, and is vertically maintained. Also, the first-second supporting unit 184*a* and the second-second supporting unit 184*b* follow both ends of the second voice coil portion 182 of which the surface is bent in a semi-circle or reverse-U-shape so as to extend up from one side of the first terminal unit 185*a* and the second terminal unit 185*b*, and is vertically maintained. Thus, the first voice coil portion 181 that is elastically supported with the first-first supporting unit 183*a* and the second-first supporting unit 183*b* can vibrate in the direction of the face thereof (vertical direction), and the second voice coil portion 182 that is elastically supported with the first-second supporting unit 184*a* and the second-second supporting unit 184*b* can vibrate in the direction of the face thereof (vertical direction).

Figure 13A:
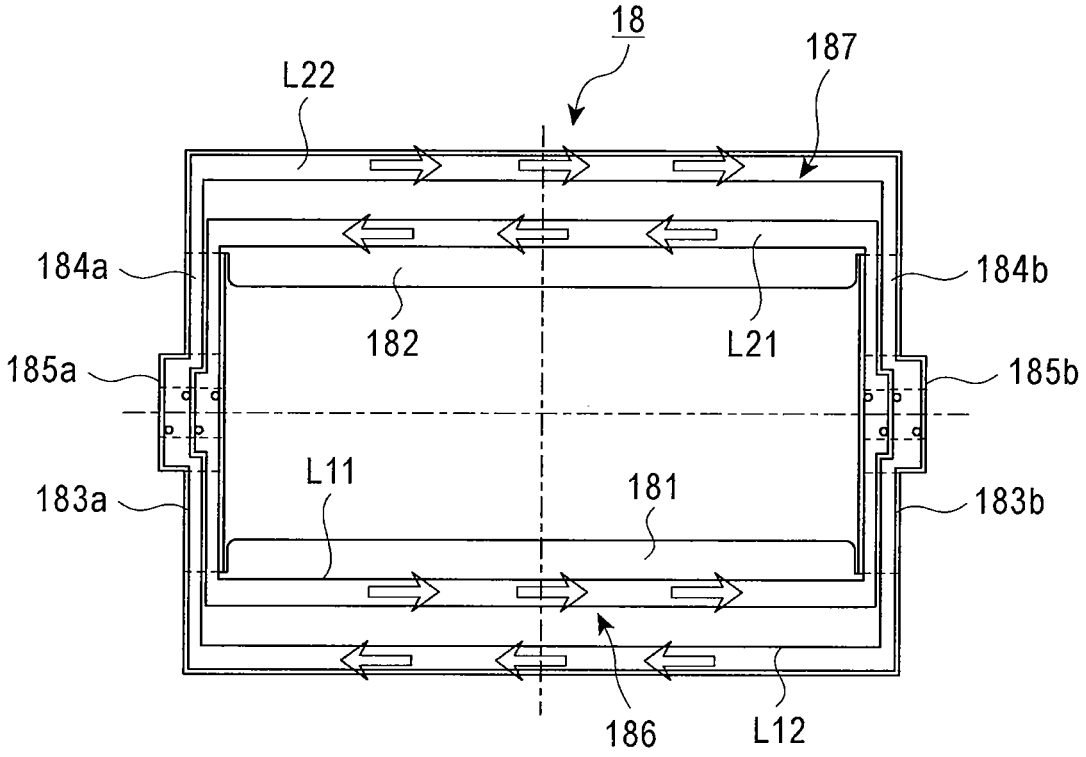
FIG. 13A is a plan view illustrating an example of a voice coil array pattern formed in the voice coil unit.

The voice coil unit 18 in a state that is laid out flat is shown in FIG. 13A. In FIG. 13A, a line pattern L11 is formed from the first terminal unit 185*a* through the first-first supporting unit 183*a*, the first voice coil portion 181 and the second-first supporting unit 183*b* to the second terminal unit 185*b*, and a line pattern L21 is formed from the second terminal unit 185*b* through the second-second supporting unit 184*b*, the second voice coil portion 182, and the first-second supporting unit 184*a*, following the line pattern L11, to return to the line pattern L11 of the first terminal unit 185*a*. That is to say, the line patterns L11 and L21 are formed circularly between the first terminal unit 185*a*, the first-first supporting unit 183*a*, the first voice coil portion 181, the second-first supporting unit 183*b*, the second terminal unit 185*b*, the second-second supporting unit 184*b*, the second voice coil portion 182, and the first-second supporting unit 184*a*. Also, on the outer side of the line patterns L11 and L21 which connect circularly, a line pattern L12 is formed from the first terminal unit 185*a* through the first-first supporting unit 183*a*, the first voice coil portion 181 and the second-first supporting unit 183*b* to the second terminal unit 185*b*, and a line pattern L22 is formed from the second terminal unit 185*b* through the second-second supporting unit 184*b*, the second voice coil portion 182, and the first-second supporting unit 184*a*, following the line pattern L12, to return to the line pattern L12 of the first terminal unit 185*a*. That is to say, the line patterns L12 and L22 are similarly formed circularly on the outer side of the line patterns L11 and L21 which connect circularly.

Two pairs of connecting points are formed on the first terminal unit 185*a*, and an audio signal is supplied to one pair of connecting points so that audio signal current flows to the line pattern L11 formed in the first voice coil portion 181 and the line pattern L21 formed in the second voice coil portion 182. Also, an audio signal is supplied to the other pair of connecting points so that audio signal current flows in the opposite direction from the audio current that flows in line patterns L11 and L21, to the line pattern L12 formed in the first voice coil portion 181 and the line pattern L22 formed in the second voice coil portion 182.

By forming the voice coil unit 18 of a laid-open configuration as shown in FIG. 13A to be in a form shown in FIG. 9, two line patterns L11 and L12 are arrayed above and below on the first voice coil portion 181, and a first voice coil line pattern 186 is configured with these line patterns L11 and L12. Also, two line patterns L21 and L22 are arrayed above and below on the second voice coil portion 182, and a second voice coil line pattern 187 is configured with these line patterns L21 and L22.

Figure 13B:
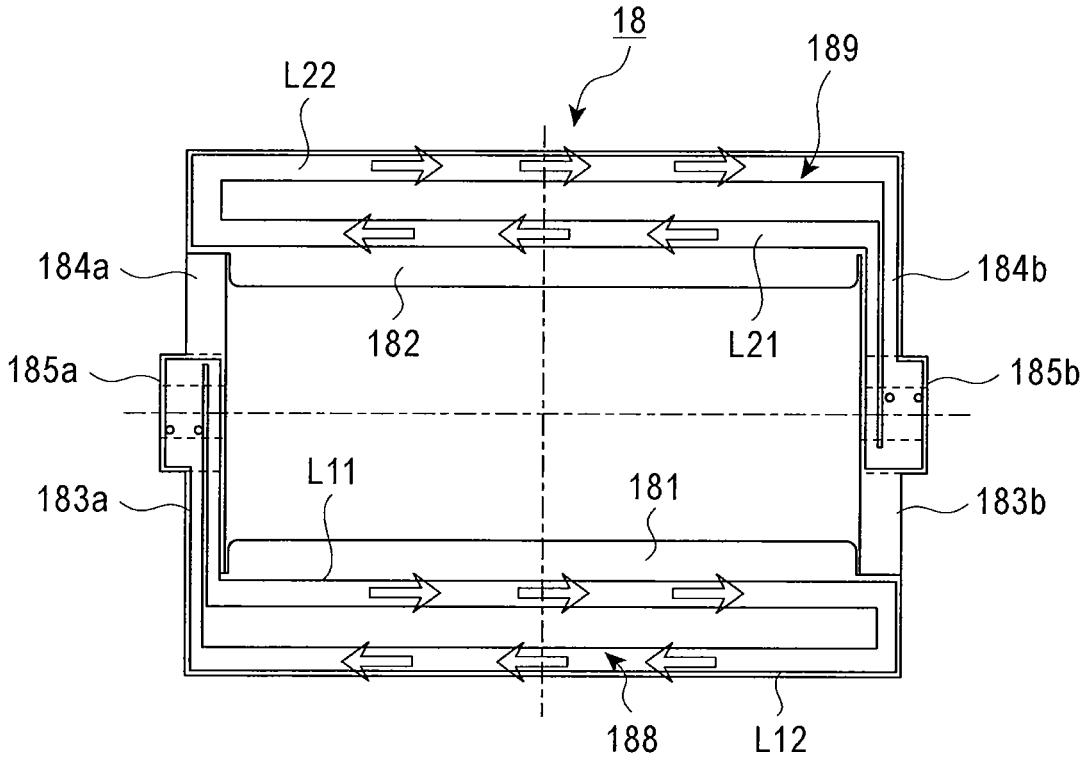
FIG. 13B is a plan view illustrating another example of a voice coil array pattern formed in the voice coil unit.

A line pattern such as shown in FIG. 13B can also be formed on the voice coil unit 18. In FIG. 13B which shows the voice coil unit 18 in a state that is laid out flat, a line pattern L11 is formed from the first terminal unit 185*a* through the first-first supporting unit 183*a* and the first voice coil portion 181 to the end portion of the first voice coil unit 181, and a line pattern L12 is formed from the end portion of the first voice coil portion 181, following the line pattern L11, through the first voice coil portion 181 and the first-first supporting unit 183*a*, to return to the first terminal unit 185*a*. That is to say, the line patterns L11 and L12 are formed in a ring shape through the first terminal unit 185*a*, the first-first supporting unit 183*a*, and first voice coil portion 181. Also, a line pattern L21 is formed from the second terminal unit 185*b* through the second-second supporting unit 184*b* and the second voice coil portion 182, to the end portion of the second voice coil unit, and a line pattern L22 is formed from the end portion of the second voice coil portion 182, following the line pattern L21, through the second voice coil portion 182 and the second-second supporting unit 184*b*, to return to the second terminal unit 185*b*. That is to say, the line patterns L21 and L22 are formed in a ring shape through the second terminal unit 185*b*, the second-second supporting unit 184*b*, and the second voice coil portion 182.

A pair of connecting points is formed on the first terminal unit 185*a*, and an audio signal is supplied to the connecting points making up this pair, whereby audio current flows in opposite directions in the line patterns L11 and L12 that are formed in a ring shape. Also, a pair of connecting points is formed on the second terminal unit 185*b*, and an audio signal is supplied to the connecting points making up this pair, whereby audio current flows in opposite directions in the line patterns L21 and L22 that are formed in a ring shape.

In the case that the voice coil unit 18 in the laid-open configuration as shown in FIG. 13B is formed into the shape shown in FIG. 9, two line patterns L11 and L12 are arrayed above and below on the first voice coil portion 181, similar to the case of the voice coil unit 18 in the configuration shown in FIG. 13A, and the first voice coil line pattern 188 is configured by the line patterns L11 and L12. Also, the two line patterns L21 and L22 are arrayed above and below on the second voice coil portion 182, and the second voice coil line pattern 189 is configured by the line patterns L21 and L22.

Figure 10:
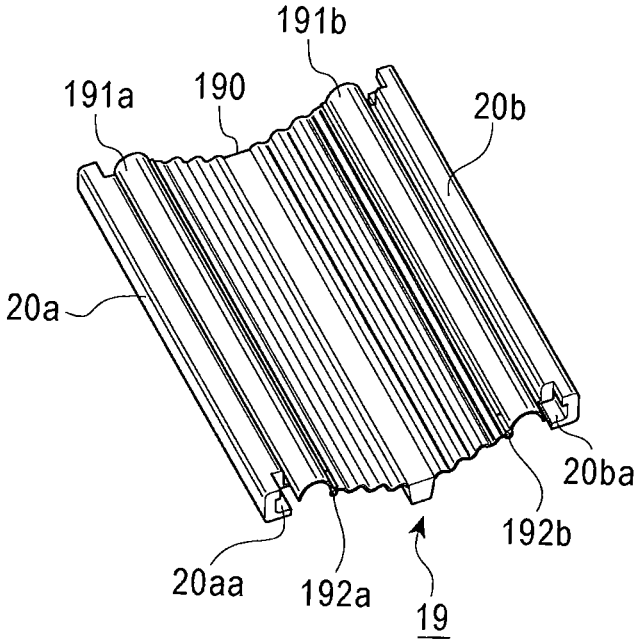
FIG. 10 is a perspective diagram illustrating a configuration of a damper member.

The damper member 19 shown in FIG. 10 is formed by extrusion molding of resin, and has a damper main unit 190 formed in a wave form, a first supporting unit 191*a* formed in an arch shape that follows one of the outer side edge portions of the damper main unit 190, and a second supporting unit 191*b* formed in an arch shape that follows the other outer side edge portion of the damper main unit 190. A first fitting groove 192*a* is formed in the border portion of the damper main unit 190 and the first supporting unit 191*a* so as to extend in the lengthwise direction, and a second fitting groove 192*b* is formed in the border portion of the damper main unit 190 and the second supporting unit 191*b* so as to extend in the lengthwise direction.

Figure 11:
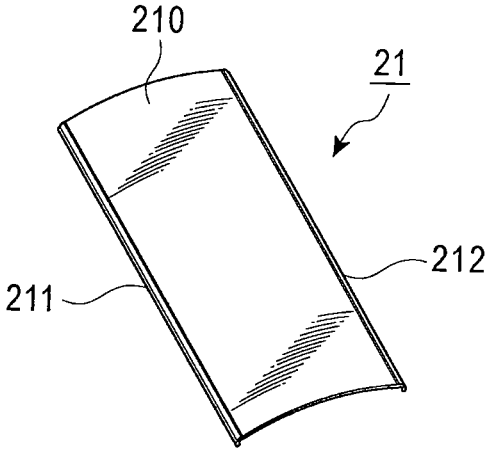
FIG. 11 is a perspective diagram illustrating a diaphragm.

The diaphragm 21 shown in FIG. 11 is formed with a material such as resin, metal, paper, or the like, and has a diaphragm main unit 210 that is in a slightly bent state and a first slide unit 211 and a second slide unit 212 that slide and fit into the first fitting groove 192*a* and the second fitting groove 192*b* of the damper member 19 on both outer edges of the diaphragm main unit 210.

Figure 12:
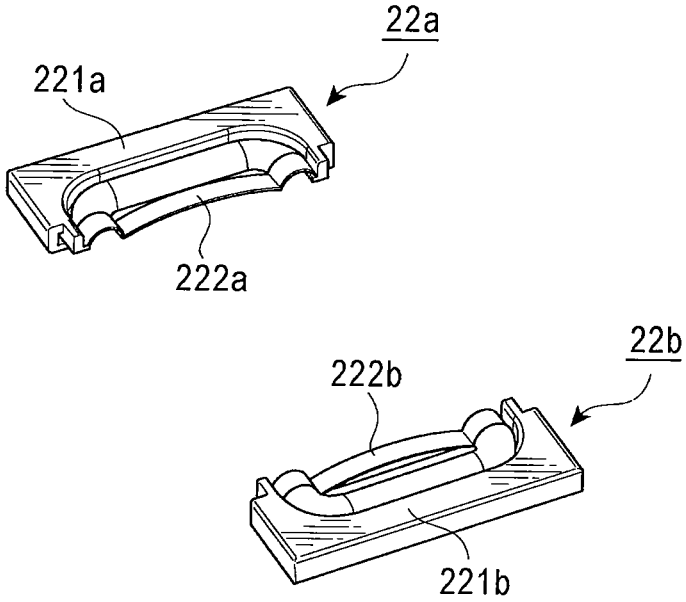
FIG. 12 is a perspective diagram illustrating a first horizontal edge portion and a second horizontal edge portion.

The first horizontal edge portion 22*a* and the second horizontal edge portion 22*b* shown in FIG. 12 are formed with a resin or the like, and as described above, has outer frame units 161*a* and 161*b* of the first positioning member 16*a* and the second positioning member 16*b*, and edge engaging portions 221*a* and 221*b* that engage so as to link to the first vertical edge portion 20*a* and the second vertical edge portion 20*b* that are fixed in the first outer edge portion 174 and the second outer edge portion 175 on both end portions in the lengthwise direction of the rectangular-shaped frame unit formed by the first outer edge portion 174 and the second outer edge portion 175 of the frame member 17 linking together. Also, edge cover portions 222*a* and 222*b* that fill in the spaces between the diaphragm 19 are formed so as to extend over the inner side of the edge engaging portions 221*a* and 221*b*.

The parts configured as described above (see FIGS. 3 through 12) are assembled as follows, whereby the speaker device 10 shown in FIG. 1 can be formed.

Figure 14:
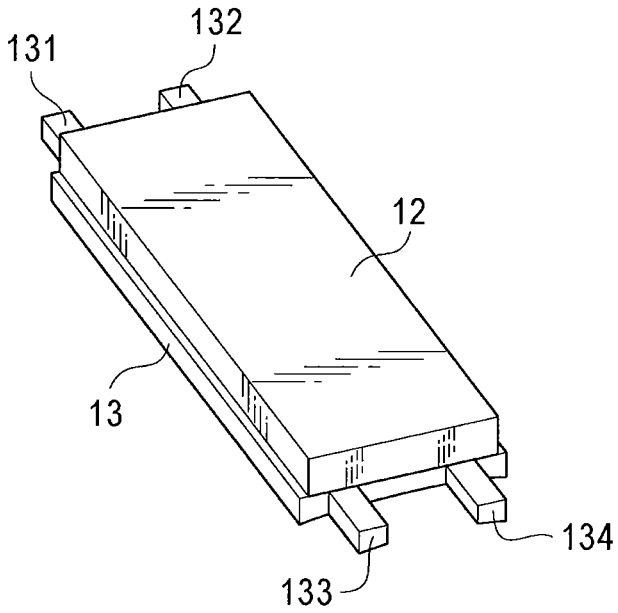
FIG. 14 is a perspective diagram illustrating a configuration unit formed by layering the magnetic plate over the second inner yoke.
Figure 15:
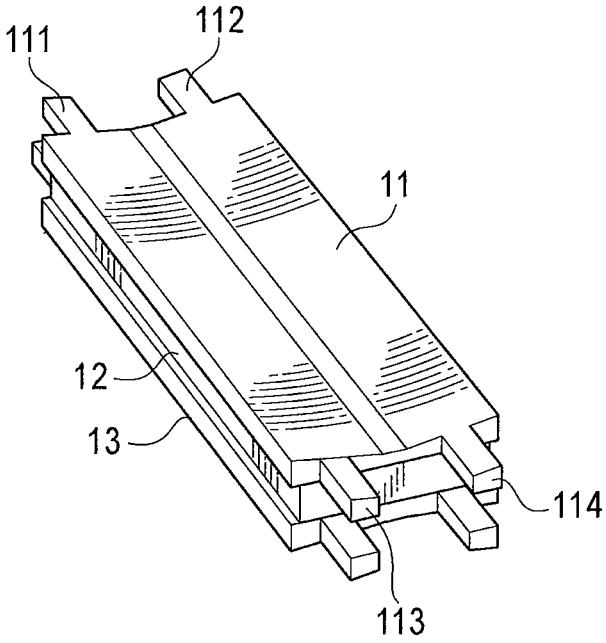
FIG. 15 is a perspective diagram illustrating a configuration unit formed by sandwiching the magnetic plate between the first inner yoke and the second inner yoke.
Figure 16:
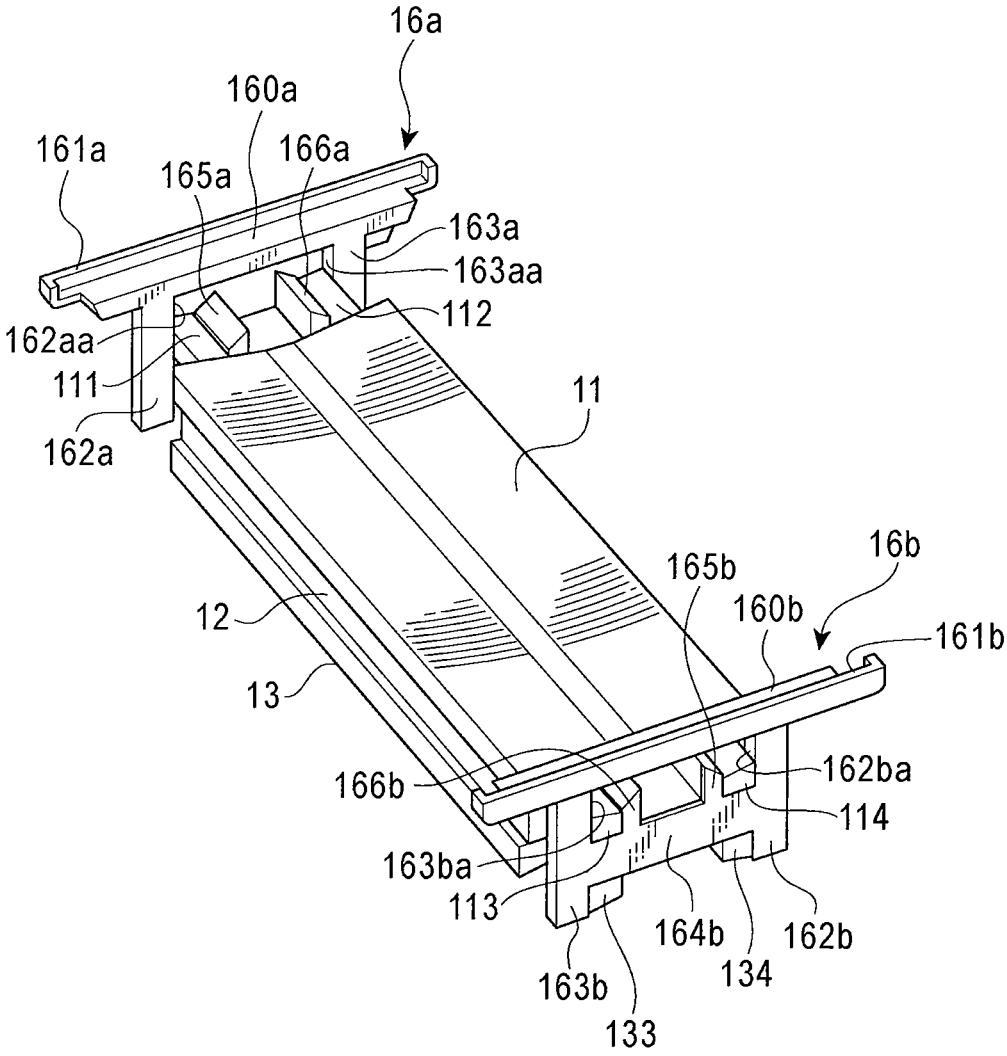
FIG. 16 is a perspective diagram illustrating a new configuration unit formed by attaching to the configuration unit shown in FIG. 15 the first positioning member and the second positioning member.

As shown in FIG. 14, a magnetic plate 12 is layered over a second inner yoke 13, and further, as shown in FIG. 15, a first inner yoke 11 is layered over the magnetic plate 12, whereby the magnetic plate 12 is sandwiched between the first inner yoke 11 and the second inner yoke 13. Note that at this time, the magnetic plate 12 is in a demagnetized state. Next, as shown in FIG. 16, the first inner yoke 11 and the second inner yoke 13 which are in the state of sandwiching the magnetic plate 12 are subjected to positioning by the first positioning member 16*a* and the second positioning member 16*b*. Specifically, the positioning protrusion 111 of the first inner yoke 11 is subjected to positioning by the inner face 162*aa* of the first horizontal spacer unit 162*a* and the first positioning face 164*aa* of the vertical spacer unit 164*a* (see FIG. 6A), in the state of being sandwiched between the first horizontal spacer unit 162*a* and the protruding portion 165*a* of the vertical spacer unit 164*a* of the first positioning member 16*a*, and the positioning protrusion 112 of the first inner yoke 11 is subjected to positioning by the inner face 163*aa* of the second horizontal spacer unit 163*a* and the second positioning face 164*ab* of the vertical spacer unit 164*a* (see FIG. 6A), in the state of being sandwiched between the second horizontal spacer unit 163*a* and the protruding portion 166*a* of the vertical spacer unit 164*a* of the first positioning member 16*a*. Also, the positioning protrusion 113 of the first inner yoke 11 is subjected to positioning by the inner face 163*ba* of the second horizontal spacer unit 163*b* and the second positioning face 164*bb* of the vertical spacer unit 164*b* (see FIG. 6B), in the state of being sandwiched between the second horizontal spacer unit 163*b* and the protruding portion 166*b* of the vertical spacer unit 164*b* of the second positioning member 16*b*, and the positioning protrusion 114 of the first inner yoke 11 is subjected to positioning by the inner face 162*ba* of the first horizontal spacer unit 162*b* and the first positioning face 164*ba* of the vertical spacer unit 164*b* (see FIG. 6B), in the state of being sandwiched between the first spacer unit 162*b* and the protruding portion 165*b* of the vertical spacer unit 164*b* of the second positioning member 16*b*.

Further, although not clearly shown in FIG. 16, the second inner yoke 13 is also subjected to positioning by the first positioning member 16*a* and the second positioning member 16*b*, similar to the first inner yoke 11. That is to say, the positioning protrusion 131 of the second inner yoke 13 is subjected to positioning by the inner face 162*aa* of the first horizontal spacer unit 162*a* and the lower face of the vertical spacer unit 164*a* in the first positioning member 16*a* (see FIG. 6A), and the positioning protrusion 132 of the second inner yoke 13 is subjected to positioning by the inner face 163*aa* of the second horizontal spacer unit 163*a* and the lower face of the vertical spacer unit 164*b* in the first positioning member 16*a* (see FIG. 6A). Also, the positioning protrusion 133 of the second inner yoke 13 is subjected to positioning by the inner face 163*ba* of the second horizontal spacer unit 163*b* and the lower face of the vertical spacer unit 164*b* in the second positioning member 16*b*, and the positioning protrusion 134 of the second inner yoke 13 is subjected to positioning by the inner face 162*ba* of the first horizontal spacer unit 162*b* and the lower face of the vertical spacer unit 164 in the second positioning member 16*b*.

Thus, the first inner yoke 11 and the second inner yoke 13 having sandwiched the magnetic plate 12 are subjected to positioning in the horizontal direction by the first positioning member 16*a* and the second positioning member 16*b*, and the spacing between the first inner yoke 11 and the second inner yoke 13 is maintained at a thickness of the vertical spacer units 164*a* and 164*b* (corresponding to the thickness of the magnetic plate 12).

Figure 17:
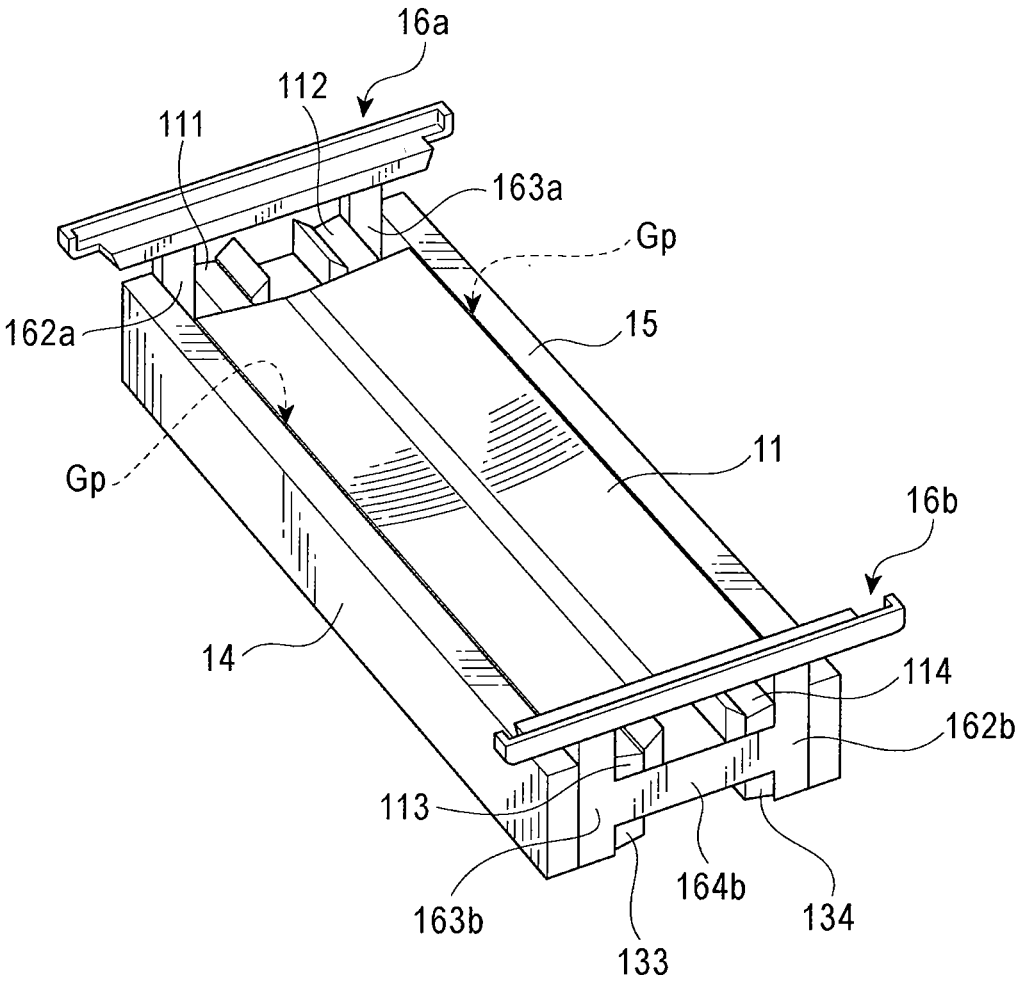
FIG. 17 is a perspective diagram illustrating a new configuration unit in a state wherein the first outer yoke and the second outer yoke are further set in the first positioning unit and the second positioning unit of the configuration unit shown in FIG. 16.

In such a state, as shown in FIG. 17, the first outer yoke 14 is pushed against the first horizontal spacer unit 162*a* of the first positioning member 16*a* and the second horizontal spacer unit 163*b* of the second position determining member 16*b*, and the second outer yoke 15 is pushed against the second horizontal spacer unit 163*a* of the first position determining member 16*a* and the first horizontal spacer unit 162*b* of the second positioning member 16*b*. Thus, the space between each of the positioning protrusions 111, 113, 131, and 133 of the first inner yoke 11 and the second inner yoke 13 and the plate face of the first outer yoke 14 is held at a spacing equivalent to the width of the first horizontal spacer unit 162*a* of the first positioning member 16*a* and the second horizontal spacer unit 163*b* of the second positioning member 16*b*, and the space between each of the positioning protrusions 112, 114, 132, and 134 of the first inner yoke 11 and the second inner yoke 13 and the plate face of the second outer yoke 15 is held at a spacing equivalent to the width of the second horizontal spacer unit 163*a* of the first positioning member 16*a* and the first horizontal spacer unit 162*b* of the second positioning member 16*b*. Consequently, as shown in the details of FIG. 2 as well as FIG. 17, a magnetic gap Gp is formed between the plate face of the first outer yoke 14 and one of the side end faces of each of the first inner yoke 11 and the second inner yoke 13, and a magnetic gap Gp is formed between the plate face of the second outer yoke 15 and the other side end face of each of the first inner yoke 11 and the second inner yoke 13.

Figure 18:
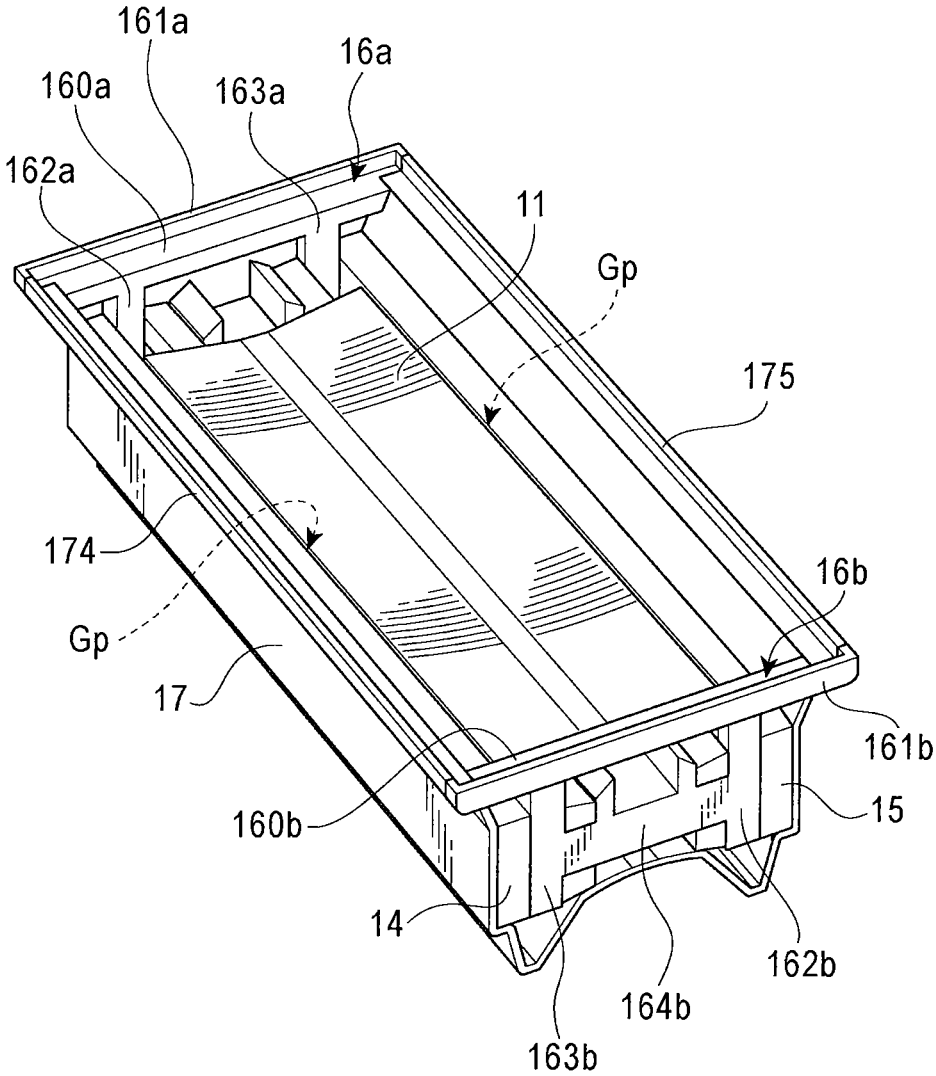
FIG. 18 is a perspective diagram showing a new configuration unit formed by attaching the frame member to the configuration unit shown in FIG. 17.

Next, the first inner yoke 11 and the second inner yoke 13 subjected to positioning by the first positioning member 16*a* and the second positioning member 16*b* in the state of sandwiching the magnetic plate 12, and the first outer yoke 14 and the second outer yoke 15, are contained within the frame member 17, as shown in detail in FIG. 2 as well as in FIG. 18. The floor portion 171 of the frame member 17 presses the second inner yoke 13 against the vertical spacer units 164*a* and 164*b* of the first positioning member 16*a* and the second positioning member 16*b*, and the first pressing unit 172 and the second pressing unit 173 of the frame member 17 sandwiches the first outer yoke 14 and the second outer yoke 15, whereby the first outer yoke 14 is pressed by the first horizontal spacer unit 162*a* of the first positioning member 16*a* and the second horizontal spacer unit 163*b* of the second position determining unit 16*b*, and the second outer yoke 15 is pressed by the second horizontal spacer unit 163*a* of the first positioning member 16*a* and the first spacer unit 162*b* of the second positioning member 16*b*. Thus, the magnetic plate 12, the first inner yoke 11, the second inner yoke 13, the first outer yoke 14, and the second outer yoke 15 which make up the magnetic circuit are integrated along with the first positioning member 16*a* and the second positioning member 16*b*.

The ends of the first outer edge portion 174 of the frame member 17 engage with one end of the outer frame unit 161*a* of the first positioning member 16*a* and one end of the outer frame unit 161*b* of the second positioning member 16*b*, and the ends of the second outer edge portion 175 of the frame member 17 engage with the other end of the outer frame unit 161*a* of the first positioning member 16*a* and the other end of the outer frame unit 161*b* of the second positioning member 16*b*. Thus, the magnetic circuit made up of the magnetic plate 12, the first inner yoke 11, the second inner yoke 13, the first outer yoke 14, and the second outer yoke 15 is surrounded by a frame unit that is made up of the first outer edge portion 174 and the second outer edge portion 175 of the frame member 17, the outer frame unit 161*a* of the first positioning member 16*a*, and the outer frame unit 161*b* of the second positioning member 16*b*.

Figure 19:
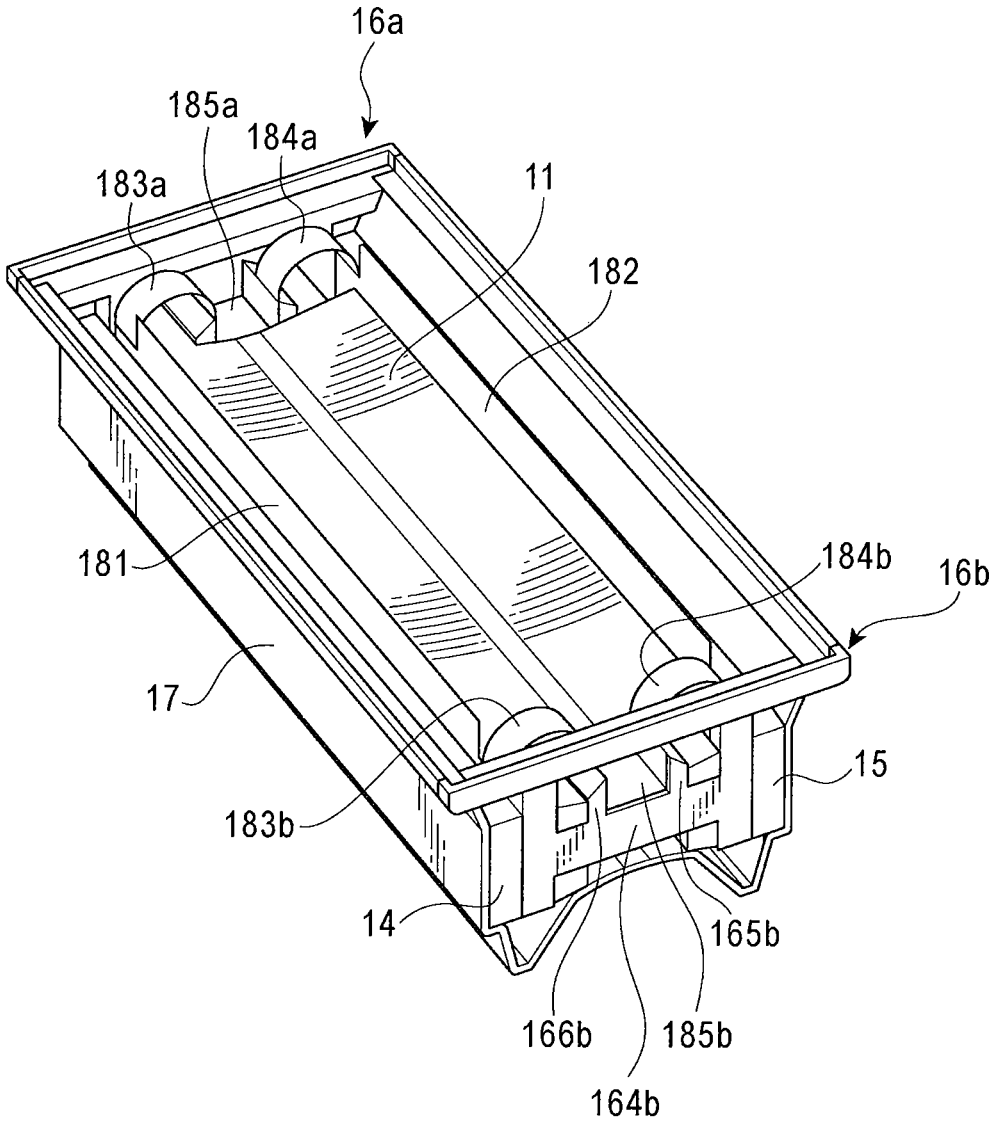
FIG. 19 is a perspective diagram showing a new configuration unit formed by attaching the voice coil unit to the configuration unit shown in FIG. 18.

Next, as shown in FIG. 19, the voice coil unit 18 is set in the above-described magnetic circuit (see FIG. 9). Specifically, a first voice coil portion 181 of the voice coil unit 18 is disposed within a magnetic gap Gp which is formed between one of the side end faces of each of the first inner yoke 11 and the second inner yoke 13 and the plate face of the first outer yoke 14, and a second voice coil portion 182 is disposed within a magnetic gap Gp which is formed between the other side end faces of each of the first inner yoke 11 and the second inner yoke 13 and the plate face of the second outer yoke 15 (see FIG. 2). A first terminal unit 185*a* is fixed to a terminal set face 167*a* between the two protruding portions 165*a* and 166*a* of the vertical spacer unit 164*a* (see FIG. 6A) in the first positioning member 16*a*, and a second terminal unit 185*b* is fixed to a terminal set face 167*b* between the two protruding portions 165*b* and 166*b* of the vertical spacer unit 165*b* (see FIG. 6B) in the second positioning member 16*b*. In this state, the first voice coil unit 181 that is disposed within the magnetic gap Gp which is formed between one side end face of each of the first inner yoke 11 and the second inner yoke 13 and the plate face of the first outer yoke 14 has both end portions elastically supported by the first-first supporting unit 183*a* that is in a shape bent so as to extend up from the first terminal portion 185*a* and bend down, and a second-first supporting unit 183*b* that is in a shape bent so as to extend up from the second terminal portion 185*b* and bend down, and can vibrate within the magnetic gap Gp in the direction of the face thereof (vertical vibration). Also, the second voice coil unit 182 that is disposed within the magnetic gap Gp which is formed between the other side end face of each of the first inner yoke 11 and the second inner yoke 13 and the plate face of the second outer yoke 15 has both end portions elastically supported by the first-second supporting unit 184*a* that is in a shape bent so as to extend up from the first terminal portion 185*a* and bend down, and a second-second supporting unit 184*b* that is in a shape bent so as to extend up from the second terminal portion 185*b* and bend down, and can vibrate within the magnetic gap Gp in the direction of the face thereof (vertical vibration).

Note that as shown in FIG. 2, the line pattern L11 of a first voice coil line pattern 186 (188) formed in the first voice coil portion 181 is arrayed between one of the side end faces of the first inner yoke 11 and the plate face of the first outer yoke 14, and the line pattern L12 of the first voice coil line pattern 186 (188) is arrayed between one of the side end faces of the second inner yoke 13 and the plate face of the first outer yoke 14. Also, the line pattern L21 of a second voice coil line pattern 187 (189) formed in the second voice coil portion 182 is arrayed between the other side end face of the first inner yoke 11 and the plate face of the second outer yoke 15, and the line pattern L22 of the second voice coil line pattern 187 (189) is arrayed between the other side end face of the second inner yoke 13 and the plate face of the second outer yoke 15.

Figure 20:
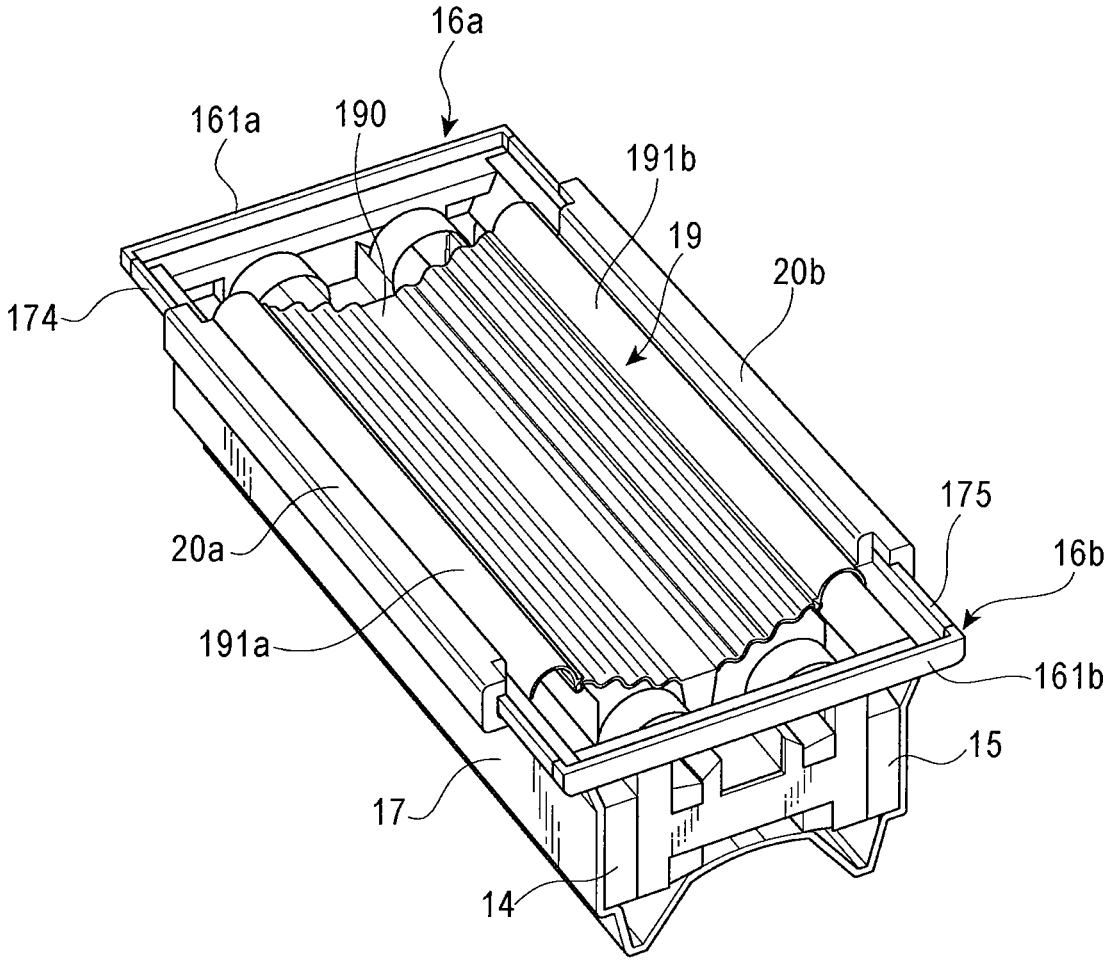
FIG. 20 is a perspective diagram illustrating a new configuration unit formed by attaching the damper member to the configuration unit shown in FIG. 19.

Next, as shown in FIG. 20, a damper member 19 is attached. A first vertical edge portion 20*a* following a first supporting unit 191*a* that is formed on one of the outer edge portions of the damper member 19 is fixed to the first outer edge portion 174 of the frame member 17, and a second vertical edge portion 20*b* following a second supporting unit 191*b* that is formed on the other outer edge portion of the damper member 19 is fixed to the second outer edge portion 175 of the frame member 17 (see FIG. 2). Thus, the damper member 19 is provided between the first outer edge portion 174 and second outer edge portion 175 of the frame member 17 so as to cover the magnetic circuit and the voice coil unit 18.

Figure 21:
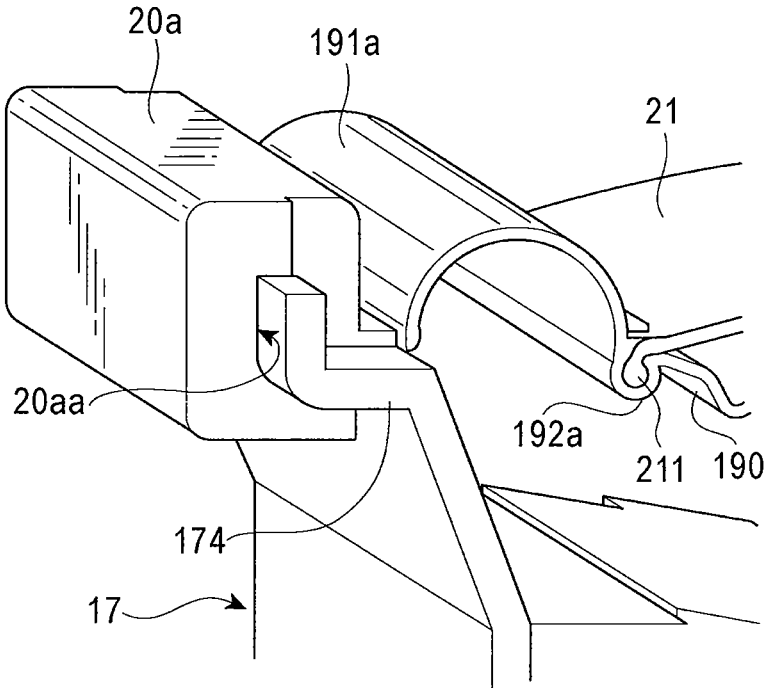
FIG. 21 is a partial expanded perspective diagram illustrating a fixed configuration of a first vertical edge unit (second vertical edge unit) and frame member in the configuration unit shown in FIG. 20.

Fixing the damper member 19 to the frame member 17 is performed, specifically, by sliding to fit the first fitting groove 20*aa* of the first vertical edge unit 20*a* onto the first outer edge portion 174 of the frame member 17, and similarly sliding to fit the second fitting groove 20*ba* of the second vertical edge unit 20*b* onto the second outer edge portion 175 on the opposite side of the frame member 17, as shown expanded in FIG. 21.

When the damper member 19 is attached, the leading edge portion of the first voice coil portion 181 extruding from the magnetic gap Gp is fixed to the border portion between the damper main unit 190 and the first supporting unit 191*a* (the portion forming the first fitting groove 192*a*) with an adhesive agent, as shown in FIG. 2. Also, the leading edge portion of the second voice coil portion 182 extruding from the magnetic gap Gp is fixed to the border portion between the damper main unit 190 and the second supporting unit 191*b* (the portion forming the second fitting groove 192*b*) with an adhesive agent. Thus, the entire voice coil unit 18 is elastically supported by the damper member 19.

Figure 22:
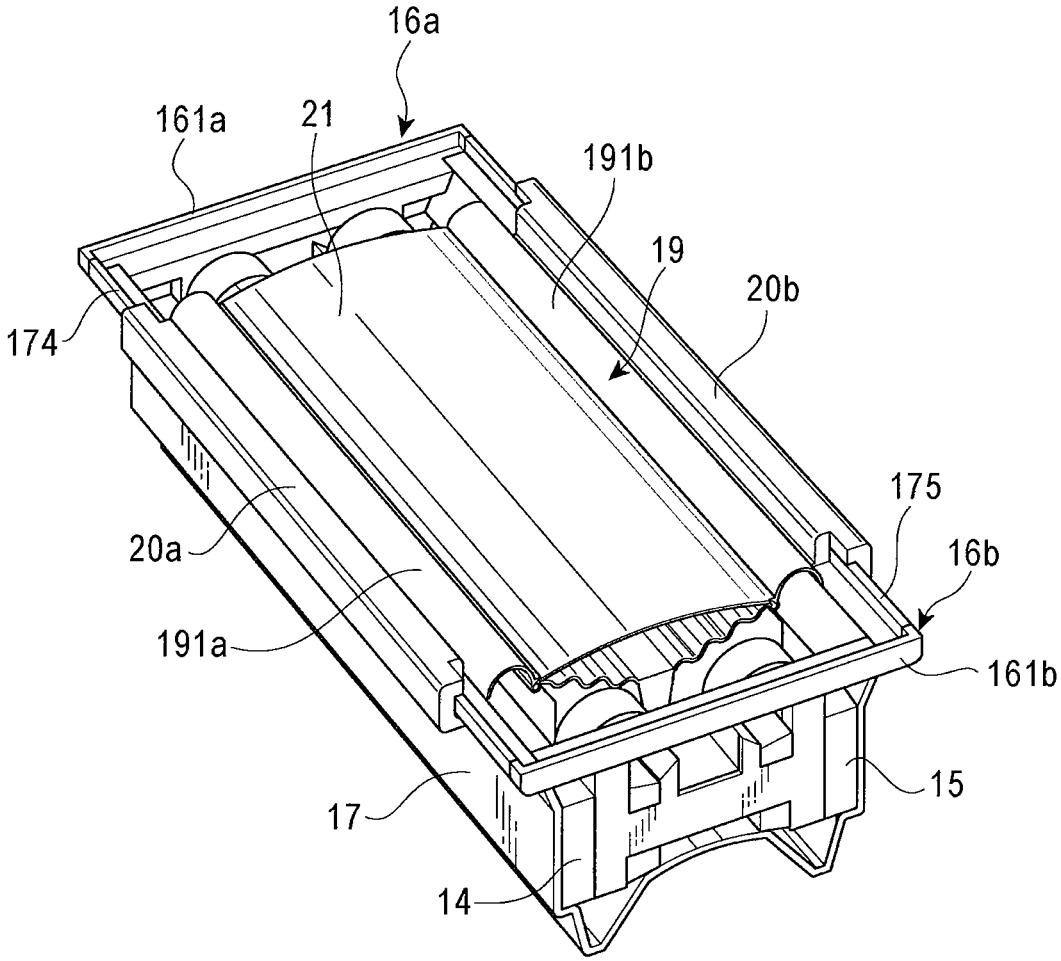
FIG. 22 is a perspective diagram illustrating a new configuration unit formed by attaching a diaphragm to the configuration unit shown in FIG. 20.
Figure 23:
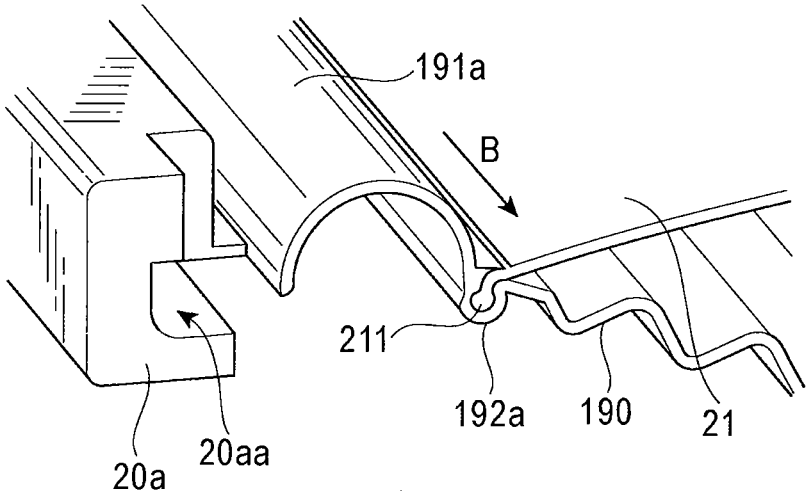
FIG. 23 is a partially expanded perspective diagram illustrating a fixed configuration of a damper member and diaphragm of a configuration unit shown in FIG. 22.

Next, as shown in FIG. 22, the diaphragm 21 is attached to the damper member 19. Specifically, as shown expanded in FIG. 23 as well as FIG. 21, a first sliding unit 211 of the diaphragm 21 is slid to fit into the first fitting groove 192*a* formed in the border portion between the damper main unit 190 and the first supporting unit 191*a*. Also, a second sliding unit 212 of the diaphragm 21 is similarly slid to fit into the second fitting groove 192*b* formed in the border portion between the damper main unit 190 and the second supporting unit 191*b*. Thus, the diaphragm 21 is fixed to the damper member 19 (damper main unit 190). Also, as described above, the leading end portion of the first voice coil portion 181 of the voice coil unit 18 is adhered to the border portion between the damper main unit 190 and the first supporting unit 191*a* with an adhesive agent, and also, the leading end portion of the second voice coil portion 182 of the voice coil unit 18 is adhered to the border portion between the damper main unit 190 and the second supporting unit 191*b* with an adhesive agent (see FIG. 2), whereby the voice coil unit 18 (first voice coil portion 181, second voice coil portion 182) are constructed to link to the diaphragm 21, and the vibrations of the voice coil unit 18 transmit to the diaphragm 21.

Lastly, as shown in FIG. 1, the first horizontal edge portion 22*a* and the second horizontal edge portion 22*b* are attached, and the assembly of the various parts is ended. Specifically, the outer frame portions 161*a* and 161*b* of the first positioning member 16*a* and the second positioning member 16*b* and the first outer edge unit 174 and the second outer edge unit 175 of the frame member 17 are linked to form a rectangular-shaped frame (see FIG. 22). The edge engaging portion 221*a* of the first horizontal edge unit 22*a* is fixed to the end portion on the outer frame unit 161*a* side of the first positioning member 16*a* of this frame, and the edge engaging portion 221*b* of the second horizontal edge unit 22*b* is fixed to the end portion on the outer frame unit 161*b* side of the second positioning member 16*b* of the frame. Thus, the edge engaging portions 221*a* and 222*a* are linked to the first vertical edge portion 20*a* and the second vertical edge portion 20*b*, and the edge cover units 222*a* and 222*b* link to the diaphragm 21 and the end edge of the damper member 19 (first supporting unit 191*a* and second supporting unit 191*b*).

When the various parts are thus assembled, the magnetic plate is magnetized. When the magnetic plate 12 is magnetized, the first inner yoke 11, the second inner yoke 13, the first outer yoke 14, and the second outer yoke 15 are drawn to the magnetic plate 12, and these are strongly integrated along with the first positioning member 16*a* and the second positioning member 16*b*. However, it should be noted that the magnetic gap Gp between one of the side end faces of each of the first inner yoke 11 and the second inner yoke 13 and the plate face of the first outer yoke 14, and the magnetic gap Gp between the other side end faces of each of the first inner yoke 11 and the second inner yoke 13 and the plate face of the second outer yoke 15 are accurately maintained by the first positioning member 16*a* and the second positioning member 16*b*.

Note that the parts that are assembled as described above may be adhesively fixed with an adhesive agent as needed before the magnetic plate 12 is magnetized.

Figure 24A:
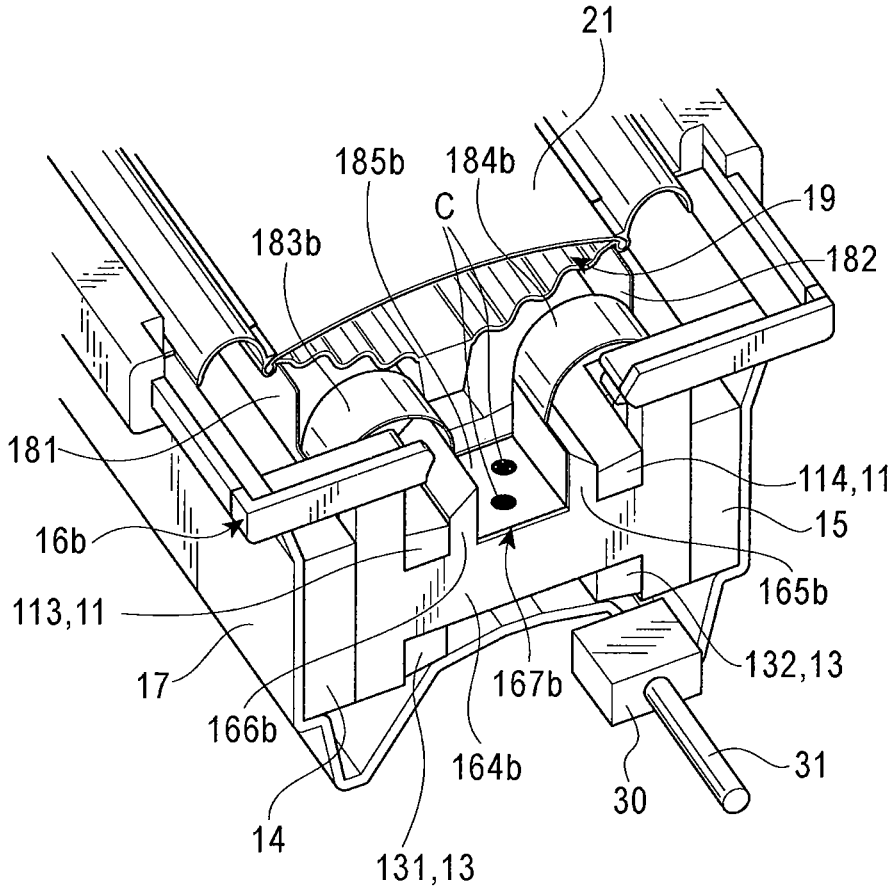
FIG. 24A is a perspective diagram illustrating an expansion of a state wherein a second terminal unit of the voice coil unit is set in a terminal set face of a second positioning member.
Figure 24B:
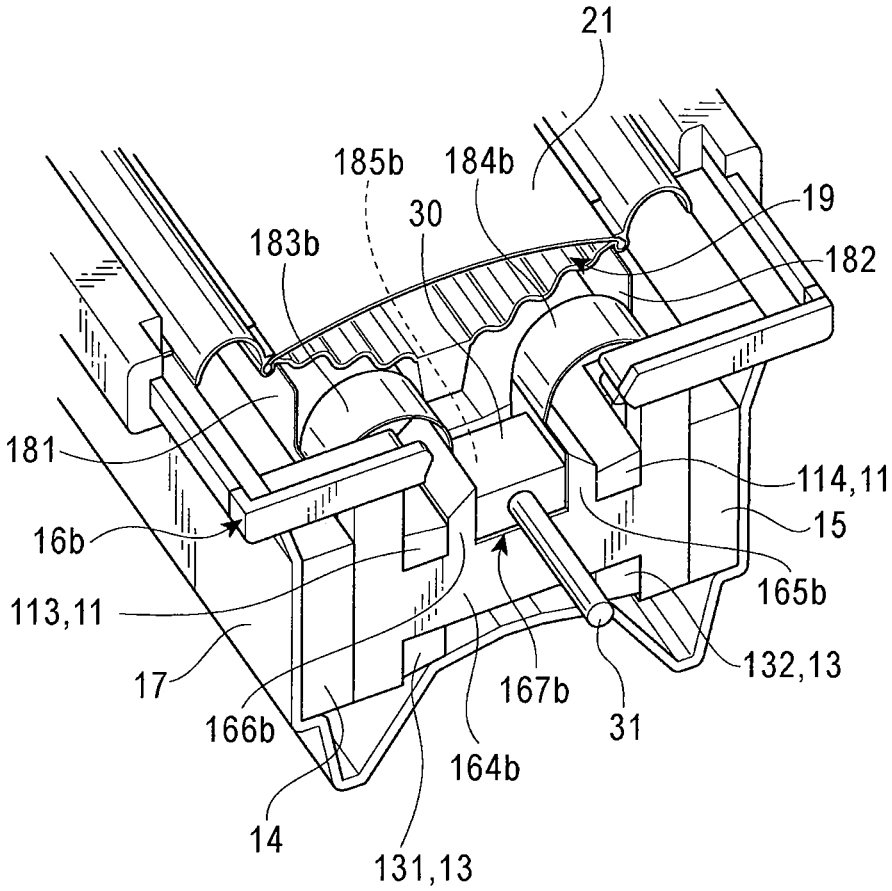
FIG. 24B is a perspective diagram illustrating an expansion of a fixed configuration of the second terminal unit of the voice coil unit that has been set in the terminal set face of the second positioning member.

The electrical connection with the audio signal output circuit of the voice coil unit 18 is as shown in FIGS. 24A and 24B. Note that FIGS. 24A and 24B show an expanded view of the configuration of the second terminal unit 185*b* of the voice coil unit 18, and the first terminal unit 185*a* of the voice coil unit 18 has the same configuration. Note that in this case, a voice coil line pattern (first voice coil line pattern 188, second voice coil line pattern 189) such as shown in FIG. 13B, for example, is formed in the first voice coil portion 181 and the second voice coil portion 182 of the voice coil unit 18.

In FIG. 24A, in the U-shape formed by the two protruding portions 165*b* and 166*b* and the terminal set face 167*b* of the vertical spacer unit 164*b* of the second positioning member 16*b* (fixed position), the second terminal unit 185*b* is set in the border portion between the second-first supporting unit 183*b* following the first voice coil portion 181 and the second-second supporting portion 184*b* following the second voice coil portion 182. A pair of connecting points C of the second voice coil line pattern 189 are formed on the second terminal unit 185*b* so as to be exposed. A coupler terminal 30 is connected to the leading edge of a lead line 31 extending from the audio signal output circuit. The coupler terminal 30 is made of resin and has an exterior shape that matches the U-shaped second terminal unit 185*b* of the voice coil unit 18. As shown in FIG. 24B, when the coupler terminal 30 is inserted into the second terminal unit 185*b* that is set in a U-shape formed with the two protruding portions 165*b* and 166*b* and the terminal set face 167*b* of the vertical spacer unit 164*b* of the second positioning member 16*b*, a connecting point (not shown) that becomes a pair following the lead line 31 of the coupler terminal 30 is pressed to make contact with the connecting points C of the second terminal unit 185*b*. Thus, the lead line 31 and the second voice coil line pattern 189 are electrically connected, and the audio signal supplied from the audio signal output circuit through the lead line 31 is supplied to the second voice coil line pattern 189 via the connecting points C of the second terminal unit 185*b*.

As described above, although the first terminal unit 185*a* on the opposite side from the second terminal unit 185*b* of the voice coil unit 18 is not shown in FIGS. 24A and 24B, similar to the case of the second terminal unit 185*b*, a coupler terminal connected to the lead line is also inserted into the first terminal unit 185*a* that is set in a U-shape formed with the two protruding portions 165*a* and 166*a* and the terminal set face 167*a* of the vertical spacer unit 164*a* of the first positioning member 16*a*. Thus, the audio signal supplied from the audio signal output circuit through the lead line 31 is supplied to the first voice coil line pattern 188 formed on the first voice coil portion 181 via the connecting points of the first terminal unit 185*a*.

The same audio signal can be supplied in parallel to the first voice coil line pattern 188 formed in the first voice coil portion 181 and the second voice coil line pattern 189 formed in the second voice coil portion 182. Also, audio signals of frequency features (e.g., for higher sounds and for lower sounds) that differ for the first voice coil line pattern 188 and the second voice coil line pattern 189 can be supplied. Further, audio signals (e.g. vocal audio and instrumental audio) that differ for the first voice coil line pattern 188 and the second voice coil line pattern 189 can be supplied.

Note that even in a case that a voice coil line pattern (first voice coil line pattern 186, second voice coil line pattern 187) such as shown in FIG. 13A, for example, is formed in the first voice coil portion 181 and the second voice coil portion 182 of the voice coil unit 18, by fitting a similar coupler terminal into the first terminal unit 185*a* or the second terminal unit 185*b* of the voice coil unit 18, audio signals can be supplied to the first voice coil line pattern 186 and the second voice coil line pattern 187 via the two pairs of connecting points. Note that a dummy coupler terminal can be inserted into a first terminal unit 185*a* or a second terminal unit 185*b* to which audio signals are not supplied.

Figure 25:
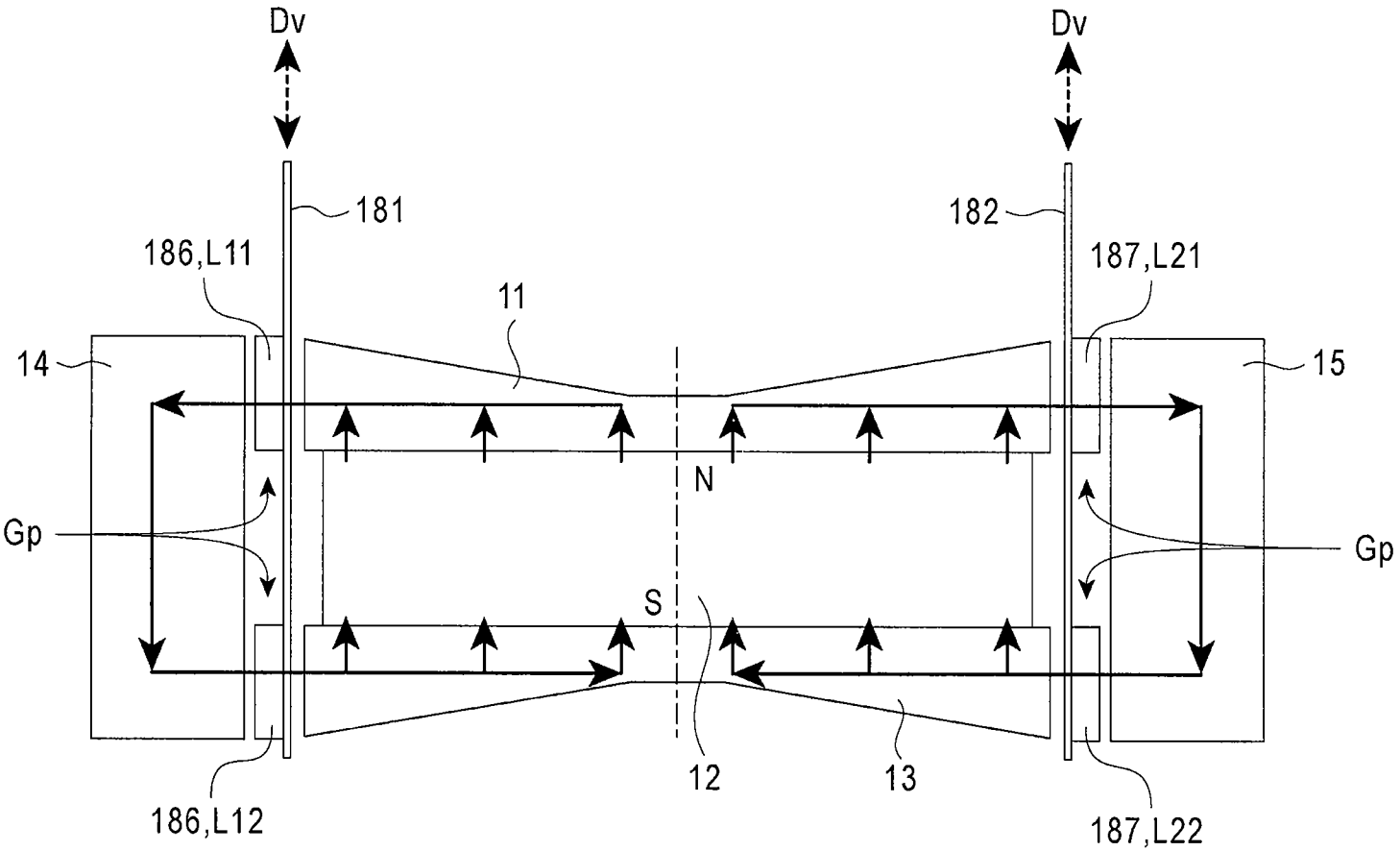
FIG. 25 is a diagram showing a magnetic flux within a magnetic circuit in a speaker device of the configuration shown in FIG. 2.

A magnetic flux is generated, as shown in FIG. 25, in the magnetic circuit (magnetic plate 12, first inner yoke 11, second inner yoke 13, first outer yoke 14, and second outer yoke 15). In FIG. 25, the magnetic flux from the North pole side of the magnetic plate 12 travels from one side face of the first inner yoke 11, cuts across the magnetic gap Gp, arrives at the first outer yoke 14, and the magnetic flux having passed through the first outer yoke 14 travels from the first outer yoke 14, cuts across the magnetic gap Gp, arrives at one side end face of the second inner yoke 13, and returns to the South pole side of the magnetic plate 12. Also, the magnetic flux from the North pole side of the magnetic plate 12 travels from the other side end face of the first inner yoke 11, cuts across the magnetic gap Gp, arrives at the second outer yoke 15, and the magnetic flux having passed through the second outer yoke 15 travels from the second outer yoke 15, cuts across the magnetic gap Gp, arrives at the other side end face of the second inner yoke 13, and returns to the South pole side of the magnetic plate 12.

An audio signal is supplied to the first voice coil line pattern 186 (L11, L12) and the second voice coil line pattern 187 (L21, L22) of the voice coil unit 18 via the coupler terminal 30 in the state that the magnetic flux is formed in the magnetic circuit as shown in FIG. 25. In FIG. 25, the magnetic flux that cuts across the magnetic gap Gp formed between one of the side end faces of the first inner yoke 11 and the plate face of the first outer yoke 14, and the magnetic flux that cuts across the magnetic gap Gp formed between one of the side end faces of the second inner yoke 13 and the plate face of the first outer yoke 14, go in opposite directions, but the direction of the audio current flowing between the line pattern L11 and the line pattern L12 of the first voice coil line pattern 186 arrayed within each magnetic gap Gp also goes in opposite directions, whereby within the face of the first voice coil portion 181, force acts in the same direction on the line pattern L11 and line pattern L12 by mutual action of the magnetic flux within the magnetic gap Gp and the audio signal current, and the first voice coil portion 181 vibrates in the direction of the face thereof (vertical direction) Dv according to the audio signal.

Also, in FIG. 25, the magnetic flux that cuts across the magnetic gap Gp formed between the other side end face of the first inner yoke 11 and the plate face of the second outer yoke 15, and the magnetic flux that cuts across the magnetic gap Gp formed between the other side end face of the second inner yoke 13 and the plate face of the second outer yoke 15, similarly go in opposite directions. In this case also, the direction of the audio current flowing between the line pattern L21 and the line pattern L22 of the second voice coil line pattern 187 arrayed within each magnetic gap Gp also goes in opposite directions, whereby force operates in the same direction within the face of the second voice coil unit 182 on the line pattern L21 and line pattern L22 by the mutual action of the magnetic flex within the magnetic gap Gp and the audio signal current, and the second voice coil portion 182 vibrates according to the audio signal, similar to the first voice coil portion 181, in the face direction thereof (vertical direction) Dv.

With the vertical direction Dv vibrations of the first voice coil portion 181 and the second voice coil portion 182 according to the audio signal, the diaphragm 21 which is linked to the voice coil portions 181 and 182 vibrates according to the audio signal. Consequently, sound corresponding to the audio signal is output.

With the speaker device 10 according to the first embodiment as described above, the first-first supporting unit 183*a* and the second-first supporting unit 183*b* following the first voice coil portion 181 and the first-second supporting unit 184*a* and the second-second supporting unit 184*b* following the second voice coil portion 182 are formed so as to be continuous, whereby the first voice coil portion 181, the second voice coil portion 182, the first-first supporting unit 183*a*, the second-first supporting unit 183*b*, the first-second supporting unit 184*a*, the second-second supporting unit 184*b*, the first terminal unit 185*a*, and the second terminal unit 185*b* can be made of a single flat piece of flexible material, and the configuration of the voice coil unit 18 can become simpler.

Also, the first-first supporting unit 183*a* and the first-second supporting unit 184*a* that follow from one end portion of the first voice coil portion 181 and the second voice coil portion 182 elastically support one end portion of the first voice coil portion 181 and the second voice coil portion 182 in a shape bent so as to extend up from the first terminal unit 185*a* which is fixed to the first positioning member 16*a*, and to bend down, and the second-first supporting unit 183*b* and the second-second supporting unit 184*b* that follow from the other end portion of the first voice coil portion 181 and the second voice coil portion 182 elastically support the other end portion of the first voice coil portion 181 and the second voice coil portion 182 in a shape bent so as to extend up from the second terminal unit 185*b* which is fixed to the second positioning member 16*b*, and to bend down, whereby in the event that the first voice coil portion 181 and the second voice coil portion 182 vibrate within the magnetic gap Gp in the direction of the faces thereof, each of the first-first supporting unit 183*a* and the second-first supporting unit 183*b* are subject to the bent shape being deformed in accordance with the vibrations of the first voice coil portion 181 while the vibrations of the first voice coil portion 181 are maintained, and also, each of the first-second supporting unit 184*a* and the second-second supporting unit 184*b* are subject to the bent shape being deformed in accordance with the vibrations of the second voice coil portion 182 while the vibrations of the second voice coil portion 182 are maintained.

Thus, in the event of the first voice coil portion 181 and the second voice coil portion 182 vibrating within the magnetic gap Gp in the face directions thereof, each of the first-first supporting unit 183*a* and the second-first supporting unit 183*b* and the first-second supporting unit 184*a* and the second-second supporting unit 184*b* are subject to the bent shape being deformed in accordance with the vibrations of the first and second voice coil portions 181 and 182 while the vibrations of the first voice coil portions 181 and 182 are maintained, whereby in the amount that the bent shape of the various supporting units 183*a*, 183*b*, 184*a*, and 184*b* are deformed, the amplitude of the vibrations of the first and second voice coil portions 181 and 182 that are elastically supported can be increased. Accordingly, the voice coil unit 18 (first voice coil portion 181, second voice coil portion 182*a*) can vibrate with a greater amplitude.

Also, in the magnetic circuit, the positioning of the first inner yoke 11, the second inner yoke, the first outer yoke 14, and the second outer yoke 15 are determined by the first positioning member 16*a* and the second positioning member 16*b* so that the magnetic gap Gp is formed, and the magnetic plate 12, the first inner yoke 11, the second inner yoke 13, the first outer yoke 14, and the second outer yoke 15 are in an integrated configuration, whereby the magnetic circuit can be assembled with good workability by the first positioning member 16*a* and the second positioning member 16*b*. Further, other parts are attached to the first positioning member 16*a* and the second positioning member 16*b*, specifically, the frame member 17, the voice coil unit 18, and the first horizontal edge portion 22*a* and the second horizontal edge portion 22*b*, whereby assembly workability is further improved.

Also, an electrical connection with the audio signal output circuit of the voice coil unit 18 is made by the coupler terminal 30 that is fit into the first terminal unit 185*a* and the second terminal unit 185*b* of the voice coil unit 18 which has been set in the first and second positioning members 16*a* and 16*b* (see FIGS. 24A and 24B), whereby electrical connections thereof can be made without soldering. Laying of the lead lines as to the voice coil unit 18 becomes simpler, and assembly is easier. Further, unnecessary load, such as being pulled by the lead line to the voice coil unit 18, can be prevented.

Note that with the speaker device according to the embodiment as described above, the first voice coil portion 181 and the second voice coil portion 182 are disposed in two magnetic gaps Gp (see FIG. 2), but a magnetic circuit can be configured such that the voice coil portions 181 and 182 are disposed in a single magnetic gap Gp. In this case, the voice coil line pattern formed in each voice coil portion 181 and 182 is formed so as to be disposed within a single magnetic gap Gp.

Also, the voice coil unit 18 has the first voice coil portion 181 and the second voice coil portion 182 made of a single flat flexible board (see FIGS. 13A and 13B), but a configuration may be made wherein each are separately elastically supported. In this case, for example, the first-first supporting unit 183*a*, the second-first supporting unit 183*b*, the first-second supporting unit 184*a*, and the second-second supporting unit 184*b* which elastically support the first voice coil portion 181 and the second voice coil portion 182 each may have the edge portion thereof fixed separately.

As described above, the speaker device according to the present invention is advantageous in that the voice coil unit can vibrate with a greater amplitude, and is useful as a speaker device that outputs sound by causing vibration of a diaphragm which is connected to a voice coil by mutual action between a magnetic field generated in a magnetic circuit and an audio signal current that flows through the voice coil.

While there has been illustrated and described what is at present contemplated to be preferred embodiments of the present invention, it will be understood by those skilled in the art that various changes and modifications may be made, and equivalents may be substituted for elements thereof without departing from the true scope of the invention. In addition, many modifications may be made to adapt a particular situation to the teachings of the invention without departing from the central scope thereof. Therefore, it is intended that this invention not be limited to the particular embodiments disclosed, but that the invention will include all embodiments falling within the scope of the appended claims.

What is claimed is:

1. A speaker device comprising:

a magnetic circuit forming a magnetic gap;

a voice coil unit disposed in said magnetic gap; and a diaphragm linked to the voice coil unit;

said magnetic circuit further forming two facing magnetic gaps; and said voice coil unit further having a first voice coil portion comprising a first voice coil line pattern on the surface of a flat flexible material and disposed in one of the magnetic gaps;

a second voice coil portion comprising a second voice coil line pattern on the surface of a flat flexible material and disposed in the other of the magnetic gaps so that the second voice coil portion is opposed to the first voice coil portion;

a first-first supporting unit and a second-first supporting unit which is formed extending from edge portions of said first voice coil portion of said flat flexible material, and which elastically support said first voice coil portion;

a first-second supporting unit and a second-second supporting unit which is formed extending from edge portions of said second voice coil portion of said flat flexible material, and which elastically support said second voice coil portion;

wherein an edge portion of each of said first-first supporting unit and said second-first supporting unit on a side opposite from said first voice coil portion is fixed to a fixing position so as to enable vibration of said first voice coil portion in one of the magnetic gaps in the direction of the face thereof;

wherein an edge portion of each of said first-second supporting unit and said second-second supporting unit on a side opposite from said second voice coil portion is fixed to a fixing position so as to enable vibration of said second voice coil portion in the other of the magnetic gaps in the direction of the face thereof;

wherein each of said first-first supporting unit and said second-first supporting unit elastically supports said first voice coil unit in a bent shape that extends up from said end portion fixed to said fixing position and bends down so that each supporting unit is bent in a semi-circle or reverse U-shape;

wherein each of said first-second supporting unit and said second-second supporting unit elastically supports said second voice coil unit in a bent shape that extends up from said end portion fixed to said fixing position and bends down so that each supporting unit is bent in a semi-circle or reverse U-shape;

wherein each of said first-first supporting unit and said second-first supporting unit, each of said first-second supporting unit and said second-second supporting unit, and each of said fixing positions are disposed respectively between the first voice coil portion and the second voice coil portion; and wherein said supporting units are not a damper of the diaphragm.

2. The speaker device according to claim 1, wherein a connecting point is formed on said end portion fixed to at least one of said fixing positions of said first-first supporting unit and said second-first supporting unit of said first voice coil portion, and a line pattern following said connecting point through said first voice coil line pattern is formed on at least one of said first-first supporting unit and said second-first supporting unit.

3. The speaker device according to claim 1, wherein a connecting point is formed on said end portion fixed to at least one of said fixing positions of said first-second supporting unit and said second-second supporting unit of said second voice coil portion, and a line pattern following said connecting point through said second voice coil line pattern is formed on at least one of said first-second supporting unit and said second-second supporting unit.

4. The speaker device according to claim 1, further comprising:

positioning members that determine the position of the parts making up said magnetic circuit, wherein the fixing positions to which the end portions of each of said first-first supporting unit and said second-first supporting unit of said first voice coil portion are fixed and the fixing positions to which the end portions of each of said first-second supporting unit and said second-second supporting unit of said second voice coil portion are fixed, are set in said positioning members.

5. The speaker device according to claim 2, wherein said fixing positions to which at least one of said end portions of said first-first supporting unit and said second-first supporting unit of said first voice coil portion on which said connecting point is formed is fixed is set into a concave portion, and a terminal member having a connecting point to make contact with said connecting point is fit into said concave portion, whereby audio signals are supplied from the outside via the terminal member to said first voice coil line pattern.

6. The speaker device according to claim 3, wherein said fixing positions to which at least one of said end portions of said first-second supporting unit and said second-second supporting unit of said second voice coil portion on which said connecting point is formed is set into a concave portion, and a terminal member having a connecting point to make contact with said connecting point is fit into said concave portion, whereby audio signals are supplied from the outside via the terminal member to said second voice coil line pattern.

7. The speaker device according to claim 1, wherein the first-first supporting unit that follows from one end portion of said first voice coil portion and the first-second supporting unit that follows from one end portion of said second voice coil portion are formed so as to be continuous, and the border portion between said first-first supporting unit and said first-second supporting unit is fixed to a first fixing position;

and wherein the second-first supporting unit that follows from the other end portion of said first voice coil portion and the second-second supporting unit that follows from the other end portion of said second voice coil portion are formed so as to be continuous, and the border portion between said second-first supporting unit and said second-second supporting unit is fixed to a second fixing position.

8. The speaker device according to claim 7, wherein a connecting point is formed on at least one of said border portions between said first-first supporting unit and said first-second supporting unit of said voice coil unit and said border portion between said second-first supporting unit and said second-second supporting unit of said voice coil unit;

and wherein the line pattern that follows said connecting point from said first voice coil line pattern and said second voice coil line pattern is formed on at least one of said first-first supporting unit and said first-second supporting unit and said second-first supporting unit and said second-second supporting unit.

9. The speaker device according to claim 7, further comprising:

a positioning member that determines the position of the parts making up said magnetic circuit, wherein the fixing position to which the border portion of said first-first supporting unit and said first-second supporting unit of said voice coil unit are fixed, and wherein the fixing position to which the border portion of said second-first supporting unit and said second-second supporting unit of said voice coil unit are fixed, are set in said positioning member.

10. The speaker device according to claim 8, wherein at least one of said first fixing position and said second fixing position, where said connecting point is formed, is set into a concave portion;

and wherein a terminal member having a connecting point to make contact with said connecting point is fit into said concave portion, whereby audio signals are supplied from the outside via the terminal member to said first voice coil line pattern and said second voice coil line pattern.

* * * * *